US007086715B2

(12) United States Patent
Yamada

(10) Patent No.: US 7,086,715 B2
(45) Date of Patent: Aug. 8, 2006

(54) METHOD OF PRINTING A TEST PATTERN, AN IMAGE FORMING DEVICE, AND A RECORDING MEDIUM ON WHICH THE TEST PATTERN IS PRINTED

(75) Inventor: Masatoshi Yamada, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 184 days.

(21) Appl. No.: 10/739,183

(22) Filed: Dec. 19, 2003

(65) Prior Publication Data

US 2004/0169694 A1 Sep. 2, 2004

(30) Foreign Application Priority Data

Dec. 20, 2002 (JP) ..... 2002-370607

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS

| | | | | |
|---|---|---|---|---|
| 5,189,521 A | 2/1993 | Ohtsubo et al. | ..... | 347/19 |
| 6,082,911 A | 7/2000 | Murakami | ..... | 347/19 |
| 2001/0036370 A1 | 11/2001 | Inoue | ..... | 399/49 |
| 2003/0085940 A1 | 5/2003 | Yamada | ..... | 347/19 |

FOREIGN PATENT DOCUMENTS

| | | | | |
|---|---|---|---|---|
| EP | 0863012 A1 * | 9/1998 | ..... | 347/19 |
| JP | B2 6-78019 | 10/1994 | ..... | 347/19 |
| JP | B2 6-78020 | 10/1994 | ..... | 347/19 |
| JP | A 9-66650 | 3/1997 | ..... | 347/19 |
| JP | A 9-94950 | 4/1997 | ..... | 347/19 |
| JP | A 9-141894 | 6/1997 | ..... | 347/19 |
| JP | A 2000-43382 | 2/2000 | ..... | 347/19 |

* cited by examiner

*Primary Examiner*—K. Feggins
*Assistant Examiner*—Julian D. Huffman
(74) *Attorney, Agent, or Firm*—Oliff & Berridge, PLC

(57) ABSTRACT

A method of printing a test pattern to form dots on a printing medium. A print head moves relative to the recording medium and the test pattern is used to inspect the printing element. The method has a line printing step for printing a dot line having predetermined length while moving the print head relative to the recording medium in a first direction of the recording medium; and a step of moving the print head relative to the recording medium in a second direction perpendicular to the first direction such that the printing element prints a dot line close to a dot line previously printed in the second direction, wherein the line printing step and the moving step are repeated alternately, and each printing element individually prints a plane image which is a assemblage of a plurality of the dot lines as a component part of the test pattern.

36 Claims, 22 Drawing Sheets

METHOD OF PRINTING A TEST PATTERN, AN IMAGE FORMING DEVICE, AND A RECORDING MEDIUM ON WHICH THE TEST PATTERN IS PRINTED

BACKGROUND OF THE INVENTION

1. Field of Invention

The invention relates to a method for printing a test pattern used to inspect a printing element which forms dots on a recording medium, to an image forming device forming a test pattern on a recording medium by the method, and to a recording medium on which a test pattern is formed by the image forming device.

2. Description of Related Art

Image forming devices, such as inkjet printers, for forming an image on a fed recording medium are widely used. As disclosed in Japanese Laid-Open Patent Publication No. 9-94950 (1997), some image forming devices are known to print a test pattern, which is a regular-shaped image, on a recording medium. The test pattern is used to check whether each printing element works correctly.

Image forming devices of this type are provided with a plurality of printing elements, a print head mounting the printing elements thereon, moving means for moving the print head above a recording medium, and control means for controlling the printing elements, the print head, and the moving means. The control means controls each element such that each element ejects droplets of ink for a predetermined period, during the time when the moving means moves the print head. The image forming device thus prints a test pattern composed of a single line printed by each printing element. Because a clogged printing element does not eject an ink droplet and therefore does not print a line, a user can judge whether each printing element is clogged, by observing the test pattern visually, or by reading the test pattern with an image-reading device, such as a scanner. The condition of each printing element is thus checked.

However, because the test pattern printed by the image forming device of this type is composed of a very thin single line, each being a sequence of droplets of ink ejected by each printing element, an automatic judgment by an image-reading device, such as a scanner, sometimes fails. Especially, when brightness of the test pattern is high, even the visual observation takes a long time to make the judgment. As the size of the printing element gets smaller, this problem becomes even more significant.

SUMMARY OF THE INVENTION

It is therefore the object of the invention to provide a method for printing a test pattern printed by an image forming device, which improves the visibility of the test pattern and reduces the time needed for the judgment.

According to one embodiment of the invention, there is provided a method of printing a test pattern on a printing medium by operating a printer having a printing element to form dots on the printing medium and a print head which mounts the printing element and moves relative to the recording medium, wherein the test pattern is used to inspect the printing element, the method having a line printing step for printing a dot line in a predetermined region on the printing medium by driving the printing element while moving the print head relative to the recording medium in a first direction of the recording medium; and a moving step of moving the print head relative to the recording medium in a second direction perpendicular to the first direction of the recording medium such that the printing element prints a dot line adjacent to a dot line previously printed immediately below the previously printed dot line, wherein the line printing step and the moving step are repeated alternately, whereby the printing element individually prints a plane image which is a assemblage of a plurality of the dot lines as a component part of the test pattern.

Thus, in the invention, instead of printing a single dot line as a test pattern, an image forming device repeats the line printing step while shifting a position to which a dot line is printed, thereby a test pattern is formed composed of the plane images whose areas are larger than those of a single dot line. As a result, visibility of the test pattern is improved and it is therefore possible to judge easily whether a printing element is clogged, by observing the test pattern visually. Also, the large area of the test pattern improves the accuracy of automatic judgment by an image-reading device, such as a scanner.

Next, when the print head includes a plurality of print heads each having a plurality of printing elements, each one of the printing elements of one print head being separated from one of the printing elements of an adjacent print head in a direction approximately parallel to the first direction, it is preferable to change a printing element printing the dot line, in some steps of the repeated line printing steps. As a result, each one of the printing elements individually prints the plane image.

When each one of printing elements individually prints the plane image in some steps of the repeated steps, it is possible to judge whether each printing element works correctly by observing the test pattern printed on the recording medium.

Although the printing element printing the dot line can be changed in some steps of the repeated steps, in the case of printing a plurality of plane images, it is more preferable to change a printing element printing the dot line in each step of the repeated line printing steps to arrange the plane images in the first direction that the print head moves, because printing time is shorter when the plane images are arranged in the first direction to reduce the number of times that the print head reciprocates, in comparison with a case where the plane images are arranged in the second direction perpendicular to the first direction to reduce the distance that the print head reciprocates.

When a printing element printing the dot line is changed in each line printing step, each one of printing elements individually prints the plane image and the plane images are arranged in the first direction. Therefore, printing time is shorter in comparison with a case where the plane images are arranged in the second direction.

Next, the printing elements can form dots of a plurality of different colors. When equipped with printing elements forming dots of a plurality of different colors, an image forming device can print a color test pattern. If the image forming device is an image forming device of an ink-jet type, the printing elements can form dots of the plurality of different colors with a plurality of different colors of ink.

Next, when brightness of a recording medium and brightness of a printed plane image are both high, visibility of the printed plane image is low, and therefore it is difficult to judge whether the plane image is printed. In such a case, it is preferable to print a background at least on an area where at least one of the printing elements prints the plane image with the brightest ink among the different colors of ink, by ejecting ink which is not the darkest among the different colors of ink, out of at least one of the other printing elements. As a result, plane images turn a mixed color. It is also preferable to print the bright plane images on two different areas, and print the ground on one of the two different areas.

According to the above, even when visibility of plane images printed with the bright ink might be low, and it might be difficult to judge whether the plane images are printed correctly, it is possible to improve the visibility by mixing two different colors of ink, because the mixed color is less bright than the brightest ink. Especially, when test patterns are printed on two different areas and a background is printed on one of the two different areas, it is possible to judge which printing element is clogged, by examining a test pattern printed with a single ink, in the case where the mixed-color test pattern has defects.

Further, when the print head includes a plurality of printing elements arranged in a direction approximately parallel to the second direction, it is preferable to divide the printing elements into blocks, every predetermined number of adjacent printing elements belonging to each one of the blocks, select one printing element from each one of the blocks, and drive the selected printing elements simultaneously, while changing the printing elements to be selected and driven. As a result, plane images are printed in predetermined intervals.

The multi-functional device, thus structured, prints a plurality of dot lines simultaneously by driving ink nozzles simultaneously, each nozzle being separated at a predetermined distance away from each adjacent nozzle. It is therefore possible to reduce printing time. Also, in this case, when each printing element is selected in order from one end of each block to the other end of the block, plane images printed by printing elements belonging to each one of the blocks are arranged in a certain direction, thereby forming a column, and plane images printed simultaneously are arranged in a direction approximately parallel to the second direction, thereby forming a row. When the plane images are in a matrix shape formed by the columns and the rows, visibility of the test pattern that is composed of the plane images is improved, and therefore it is possible to compare easily the plane image with the adjacent plane images.

Next, information can be printed in the vicinity of at least one column and one row arbitrarily selected from the matrix of the plane images to identify each printing element which printed each of the plane images. Also, the information can be printed, irrespective of whether the plane images are formed in a matrix shape.

It is possible to reduce the time needed for identifying defective printing elements by printing information in the vicinity of the plane image to identify each printing element which printed each of the plane images. Especially, when the plane images are arranged in a matrix shape, it is possible to identify easily each printing element, which printed each of the plane images, only by printing the information in the vicinity of at least one column and one row arbitrarily selected from the matrix of the plane images.

Moreover, the information is preferably an identification number including a numeral or a character although the information can be a symbol or a mark. When the information is an identification number including a numeral or a character, the information is more identifiable and it is therefore possible to reduce the time needed for identifying defective printing elements. Furthermore, the identification number can be printed inside the plane image instead of printed in the vicinity of the plane image.

As described above, when the identification number is printed in the vicinity of or inside the plane image, it is possible to identify the defective printing elements. When the brightness of the plane image is comparatively low, it is preferable to form a non-printed area in the line printing step by driving the printing elements intermittently.

For example, when a frame-shaped plane image is printed, inside which a non-printed area is formed to print the identification number thereon, it is possible to perceive an identification number even when the identification number is printed inside the plane image, the brightness of which is comparatively low.

Although the printing condition can be variable in the line printing step, the dot line is printed under approximately the same conditions in every line printing step such that the plane image becomes a parallelogram. By examining concentration or gradation of the plane image formed in this manner, it is possible to check the amount of ejected ink and ejecting ability.

Moreover, when the printing element is structured such that a size of the dot is variable, the dot line can be divided into a plurality of segments, and the size of the dot can be varied every time printing one of the segments is finished in the line printing step.

When a printing element that is almost clogged forms dots on a sheet, the printing element forms dots in some cases, but does not form dots in other cases. Therefore, executing the plane image printing process only once is not sufficient to judge whether an ink nozzle is clogged. By dividing one dot line into segments and varying a size of dot formed on a sheet, the difference between normal printing elements and defective ones becomes more apparent, and the identification of ink nozzles that are almost clogged becomes easier.

According to another aspect of the invention, there is provided an image forming device having a printing element to form dots on a printing medium, a print head which mounts the printing element and moves relative to the recording medium, line printing means for driving the printing element to print a dot line in a predetermined region on the recording medium while moving the print head relative to the recording medium in a first direction of the recording medium, moving means for moving the print head relative to the recording medium in a second direction perpendicular to the first direction of the recording medium such that the printing element prints a dot line adjacent to and immediately below a dot line previously printed, and control means for driving the line printing means and the moving means alternately to form a plane image as a component part of a test pattern which is used to inspect the printing element.

Thus, in the invention, instead of printing a single dot line as a test pattern, an image forming device prints dot lines repeatedly while shifting a position to which a dot line is printed, thereby forming a test pattern composed of the plane images whose areas are larger than those of a single dot line. As a result, visibility of the test pattern is improved and therefore it is possible to judge easily whether a printing element is clogged, by observing the test pattern visually. Also, the large area of the test pattern improves the accuracy of an automatic judgment by an image reading device, such as a scanner.

Next, when the print head includes a plurality of print heads each having a plurality of printing elements, each one of the printing elements of one print head being separated from each one of the printing elements of an adjacent print head in a direction approximately parallel to the first direction, the control means can change a printing element which the line printing means drives. As a result, each one of printing elements individually prints the plane image.

When each one of printing elements individually prints the plane image, it is possible to judge whether each printing element works correctly by observing the test pattern printed on a recording medium.

Although the control means can change the printing element printing the dot line anytime when the line printing means prints the dot line in the first direction, in the case of printing a plurality of plane images, it is more preferable that the control means changes a printing element printing the dot line every time the line printing means prints the dot line in the first direction to arrange the plane images in the first direction, because printing time is shorter when the plane images are arranged in the first direction that the print head moves, to reduce the number of times that the print head reciprocates, in comparison with a case where the plane images are arranged in the second direction perpendicular to the first direction to reduce the distance that the print head reciprocates.

When the control means changes a printing element printing the dot line every time the line printing means prints the dot line in the first direction, each-one of the printing elements individually prints the plane image and the plane images are arranged approximately in the first direction. Therefore, the printing time is shorter in comparison with a case where the plane images are arranged in the second direction.

Next, the printing elements can form dots of a plurality of different colors. When equipped with printing elements forming dots of a plurality of different colors, an image forming device can print a color test pattern. If the image forming device is an image forming device of an ink-jet type, the printing elements can form dots of a plurality of different colors with a plurality of different colors of ink.

Next, when the brightness of a recording medium and the brightness of a printed plane image are both high, visibility of the printed plane image is low, and therefore it is difficult to judge whether the plane image is printed completely or properly. In such a case, it is preferable to introduce a background printing means to the image forming device for printing a background at least on an area where at least one of the printing elements prints the plane image with the brightest ink among the different colors of ink, by ejecting ink which is not the darkest among the different colors of ink, out of at least one of other printing elements. As a result, plane images turn a mixed color. It is also preferable to print the bright plane images on two different areas, and print the background on one of the two different areas.

When the test pattern is printed with the image forming device as described above, even when visibility of plane images printed with the brightest ink might be low, and it might be difficult to judge whether the plane images are printed correctly, it is possible to improve the visibility by mixing two different colors of ink, because the mixed color is less bright than the brightest ink. Especially, when test patterns are printed on two different areas and a background is printed on one of the two different areas, it is possible to judge which printing element is clogged, by examining a test pattern printed with a single ink, in a case where a mixed test pattern has defects.

Furthermore, when the print head includes a plurality of printing elements arranged in a direction approximately parallel to the second direction, it is preferable that the control means divides the printing elements into blocks, every predetermined number of adjacent printing elements belonging to each one of the blocks, selects one printing element from each one of the blocks, and drives the selected printing elements simultaneously, while changing the printing elements to be selected and driven. As a result plane images are printed in predetermined intervals.

The multi-functional device thus structured, prints a plurality of dot lines simultaneously by driving ink nozzles simultaneously, each nozzle being separated at a predetermined length away from each adjacent nozzle. It is therefore possible to reduce printing time. Also, in this case, when the control device selects each printing element in order from one end of each block to the other end of the block, plane images printed by printing elements belonging to each one of the blocks are arranged in a certain direction, thereby forming a column, and plane images printed simultaneously are arranged in a direction approximately parallel to the second direction, thereby forming a row. When the plane images are in a matrix shape formed by the columns and the rows, visibility of the test pattern composed of the plane images is improved, and therefore it is possible to compare easily the plane image with the adjacent plane images.

Next, information printing means can be introduced to the image forming device for printing information in the vicinity of at least one column and one row arbitrarily selected from the matrix of the plane images to identify each printing element which printed each of the plane images. Also, the information can be printed, irrespective of whether the plane images are formed in a matrix shape.

It is possible to reduce the time needed for identifying defective printing elements by printing position information in the vicinity of the plane image to identify each printing element which printed each of the plane images. Especially, when the plane images are arranged in a matrix shape, it is possible to easily identify each printing element which printed each of the plane images, only by printing the information in the vicinity of at least one column and one row arbitrarily selected from the matrix of the plane images.

Moreover, the information is preferably an identification number including a numeral or a character although the information can be a symbol or a mark. When the information is an identification number including a numeral or a character, the information is more identifiable and it is therefore possible to reduce the time needed for identifying defective printing elements. Furthermore, the identification number can be printed inside the plane image instead of printed in the vicinity of the plane image.

As describe above, when the identification number is printed in the vicinity of or inside the plane image, it is possible to identify defective printing elements. When the brightness of the plane image is comparatively low, it is preferable to form a non-printed area in the line printing step by driving the printing elements intermittently.

For example, when a frame-shaped plane image is printed, inside which a non-printed area is formed to print the identification number thereon, it is possible to perceive an identification number even when the identification number is printed inside the plane image, the brightness of which is comparatively low.

Although the printing condition can be variable in the line printing step, the dot line is printed under approximately the same conditions in every line printing step such that the plane image becomes a parallelogram. By examining the concentration or gradation of the plane image formed in this manner, it is possible to check the amount of ejected ink and the ejecting ability.

Moreover, when the printing element is structured such that a size of the dot is variable, the control means can divide the dot line into a plurality of segments, and control the line printing means such that the line printing means varies the size of the dot every time the line printing means finishes printing one of the segments.

When a printing element that is almost clogged forms dots on a sheet, the printing element forms dots in some cases, but does not form dots in other cases. Therefore, executing the plane image printing process only once is not sufficient to judge whether an ink nozzle is clogged. By dividing one dot line into segments and varying the size of the dots formed on the recording medium, the difference between normal printing elements and defective ones becomes more apparent, and the identification of ink nozzles that are almost clogged becomes easier.

According to another aspect of the invention, there is provided a recording medium on which a test pattern is printed by the above-described image forming device. By observing the test pattern printed on the recording medium, it is possible to check the condition of each printing element.

BRIEF DESCRIPTION OF THE DRAWINGS

This invention will be described with reference to the drawings, in which.

DETAILED DESCRIPTION OF PREFERRED EMBODIMENTS

Figure 1:
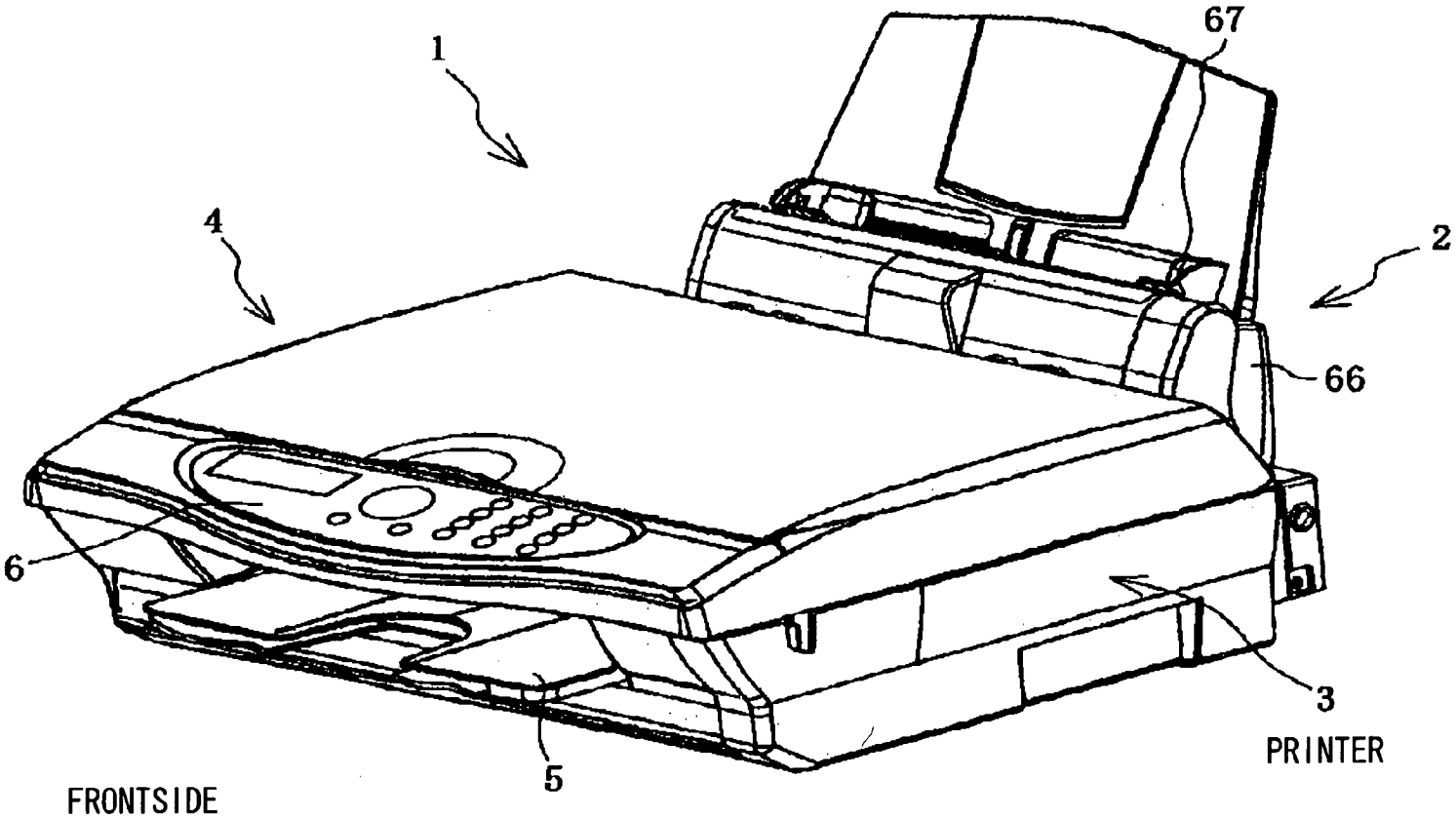
FIG. 1 is a perspective view of a multi-functional device according to an embodiment of the invention.

This embodiment is an example of the invention applied to a multi-functional device with the functions of a printer, a copier, a scanner, a facsimile and a telephone. FIG. 1 shows a perspective view of the multi-functional device 1.

As shown in FIG. 1, the multi-functional device 1 is provided with a sheet-supply device 2 at the rear end thereof, an inkjet printer 3 to a lower front side of the sheet-supply device 2, and a reading device 4, for the copying and facsimile functions, located above the inkjet printer 3. A discharge tray 5 is provided on the front side of the inkjet printer 3, a control panel 6 is provided on a front part of an upper surface of the reading device 4.

The sheet-supply device 2 includes an inclined-wall section 66 for supporting sheets in an inclined posture, and extensible sheet-guides 67 detachably mounted on the inclined-wall section 66, thereby the sheet-supply device 2 is capable of stacking a plurality of sheets. A sheet-supply motor (not shown) and a sheet-supply roller (not shown) are built into the inclined-wall section 66. As the sheet supply roller rotates, due to a driving force of the sheet supply motor, the rotating sheet-supply-roller feeds a sheet into the ink-jet printer 3. The extensible sheet guides 67 extend equally to both sides in a widthwise direction while maintaining the center position of the plurality of sheets stacked on the inclined-wall section 66, and they prevent the sheets from sliding in the widthwise direction.

Figure 2A:
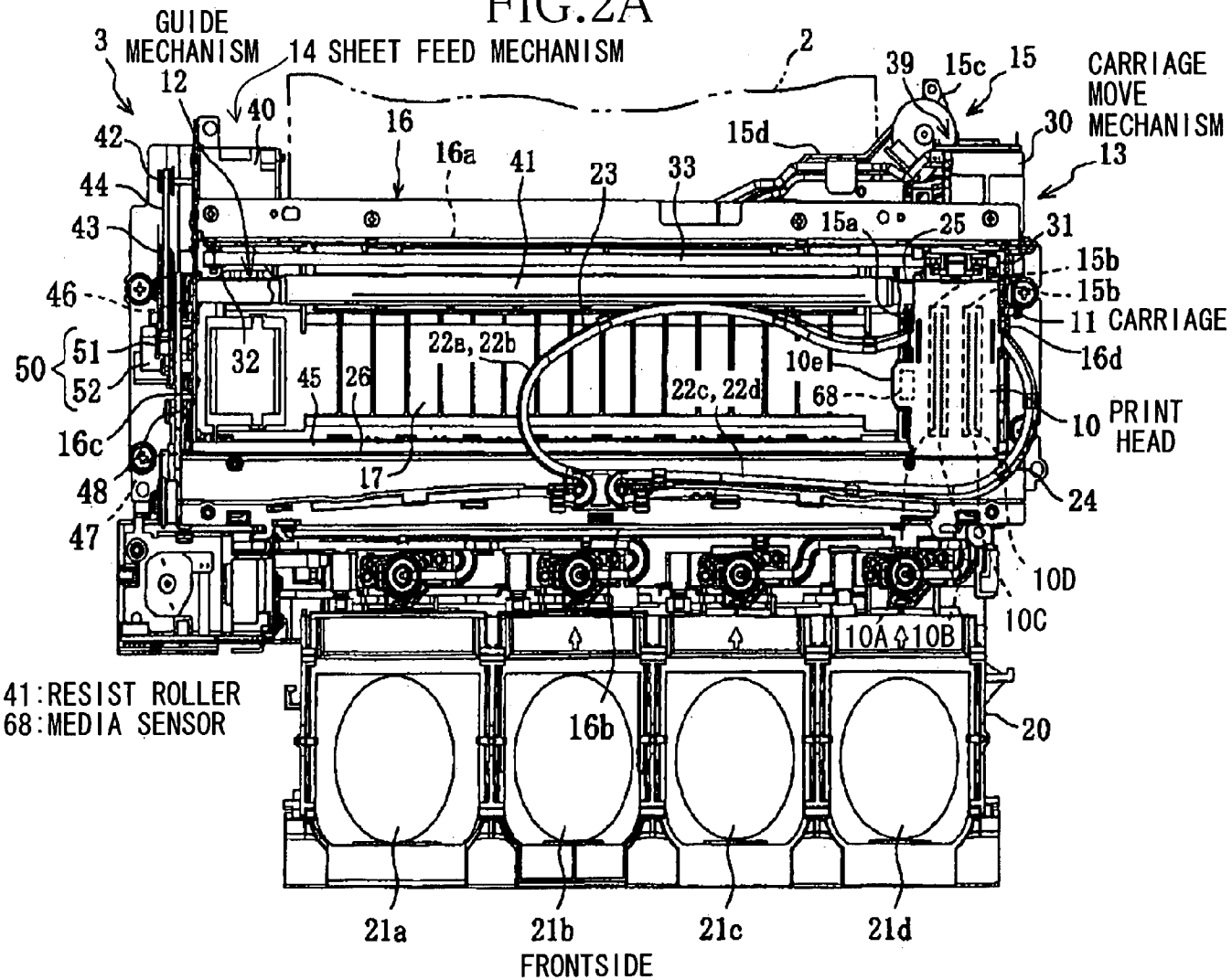
FIG. 2(A) is a plan view showing a printer of the multi-functional device.

The inkjet printer will be described with reference to FIG. 2(A). FIG. 2(A) shows a plan view of the inside structure of the inkjet printer 3. As shown in FIG. 2(A), the inkjet printer 3 includes a print head 10, a carriage 11 mounting the print head 10 thereon, a guide mechanism 12 movably supporting the carriage 11 and guiding the carriage 11 in a scanning direction (a lateral direction as viewed in FIG. 2(A)), a carriage-move mechanism 13 that moves the carriage 11 in the scanning direction, a sheet-feed mechanism 14 that feeds a sheet supplied by the sheet-supply device 2, and a maintenance mechanism 15 for the print head 10.

The inkjet printer 3 includes a frame 16. The frame 16 is in the shape of a rectangular parallelepiped, which is long in width (lateral direction) and short in height (front to rear) (FIG. 2(A)). The guide mechanism 12, the carriage-move mechanism 13, the sheet-feeding mechanism 14, and the maintenance mechanism 15 are mounted on the frame 16. Also, inside the frame 16, the print head 10 and the carriage 11 are accommodated movably in the scanning direction.

A sheet-supply opening (not shown) and a sheet-discharge opening (not shown) are formed in a rear wall 16*a* and a front wall 16*b* of the frame 16, respectively. A sheet supplied by sheet-supply device 2 is introduced into the frame 16 from the sheet-supply opening, fed forward by the sheet feed mechanism 14, and discharged out of the sheet discharge opening. A platen 17, having a plurality of ribs thereon, is provided on the bottom of the frame 16. Printing is performed on a sheet moving on the upper surface of the platen 17 inside the frame 16.

Ink cartridges 21*a*–21*d* for four different colors of ink, mounted on a cartridge-mounting portion 20 provided on a front side of the frame 16, are connected to the print head 10 via four flexible ink tubes 22*a*–22*d* passing through the inside of the frame 16. The four different colors of ink are provided to the print head 10 from the ink cartridges 21*a*–21*d* via the four flexible ink tubes 22*a*–22*d*

Two flexible print circuits (FPC's) 23, 24 are provided inside the frame 16. The left-side FPC 23 extends integrally with ink tubes 22*a*, 22*b* and is connected to the print head 10. The right-side FPC 24 extends integrally with ink tubes 22*c*, 22*d* and is also connected to the print head 10. A plurality of signal lines is wired on the FPC's 23, 24 to connect a processing device 70 (to be described later) and the print head 10 electrically.

The guide mechanism 12 includes a guide shaft 25 and guide rail 26. The guide shaft 25 is provided in the lateral direction in the rear part inside of the frame 16 and left and right ends thereof are connected to a left wall 16*c* and a right wall 16*d* of the frame 16, respectively. The guide rail 26 is provided in the lateral direction in the front part inside of the frame 16. The guide shaft is inserted slidably through a rear part of the carriage 11 and the guide rail is in sliding contact with a front part of the carriage 11. The carriage 11 can, therefore, move slidably in the lateral direction.

The carriage-move mechanism 13 includes a carriage motor 30 attached to a backside of right end part of the rear wall 16*a* of the frame 16, a drive pulley 31 driven by the carriage motor 30, a driven pulley 32 rotatably supported on a left end part of the rear wall 16*a*, and a belt 33 looped over the pulleys 31, 32 and fixed to the carriage 11. A first encoder 39 is provided in the vicinity of the carriage motor 30 for detecting the amount of movement of the carriage 11, in other words, detecting the amount of movement of the print head 10.

The sheet-feed mechanism 14 includes a feed motor 40 attached on a left rear extending part of the left wall 16*c* of the frame 16, the part extending backward with respect to the rear wall 16*a*, a resist roller 41 provided below the guide shaft 25 and extending in a lateral direction inside the frame 16, the left and right ends of the resist roller 41 being supported rotatably by the left wall 16*c* and the right wall 16*d* respectively, a drive pulley 42 driven by the feed motor 40, a driven pulley 43 connected to the left end of the resist roller 41, and a belt 44 looped over the pulleys 42, 43. As the feed motor 40 is driven, the resist roller 41 rotates, and thereby becomes capable of feeding a sheet both forward and backward. Although the resist roller 41 is seen from the top in FIG. 2(A) for clarity of the explanation, the resist roller 41 is actually provided below the guide shaft 25.

The sheet feed mechanism 14 also includes a discharge roller 45 provided in a front part of the inside of frame 16 and extending in a lateral direction, the left and right ends of the discharge roller 45 being supported rotatably by the left wall 16*c* and the right wall 16*d*, respectively, a driven pulley 46 integrally formed with the driven pulley 43, a driven pulley 47 connected to a left end of the discharge roller 45, and a belt looped over pulleys 46, 47. As the feed motor 40 is driven, the discharge roller 45 rotates, and thereby becomes capable of discharging a sheet to the discharge tray 5 (FIG. 1).

An encoder disc 51 is fixed to the driven pulley 43 and is located between a light-emitting portion and a light-receiving portion of a photo-interrupter. The photo-interrupter is attached on the left wall 16*c*. The feed motor 40 is driven and controlled by a processing device 70 (to be described later) based on a detected signal from the photo-interrupter 52 (second encoder 50).

As show in FIG. 2(A), a media sensor 68 is provided at the left end of the print head 10 for detecting a leading edge, a trailing edge and side edge of a sheet. The media sensor 68 is an optical sensor including a light-emitting portion (a light-emitting device) and a light-receiving portion (a light-receiving device), attached downwardly on a sensor mounting portion 10*e*, which protrudes leftward from the print head 10.

Figure 3:
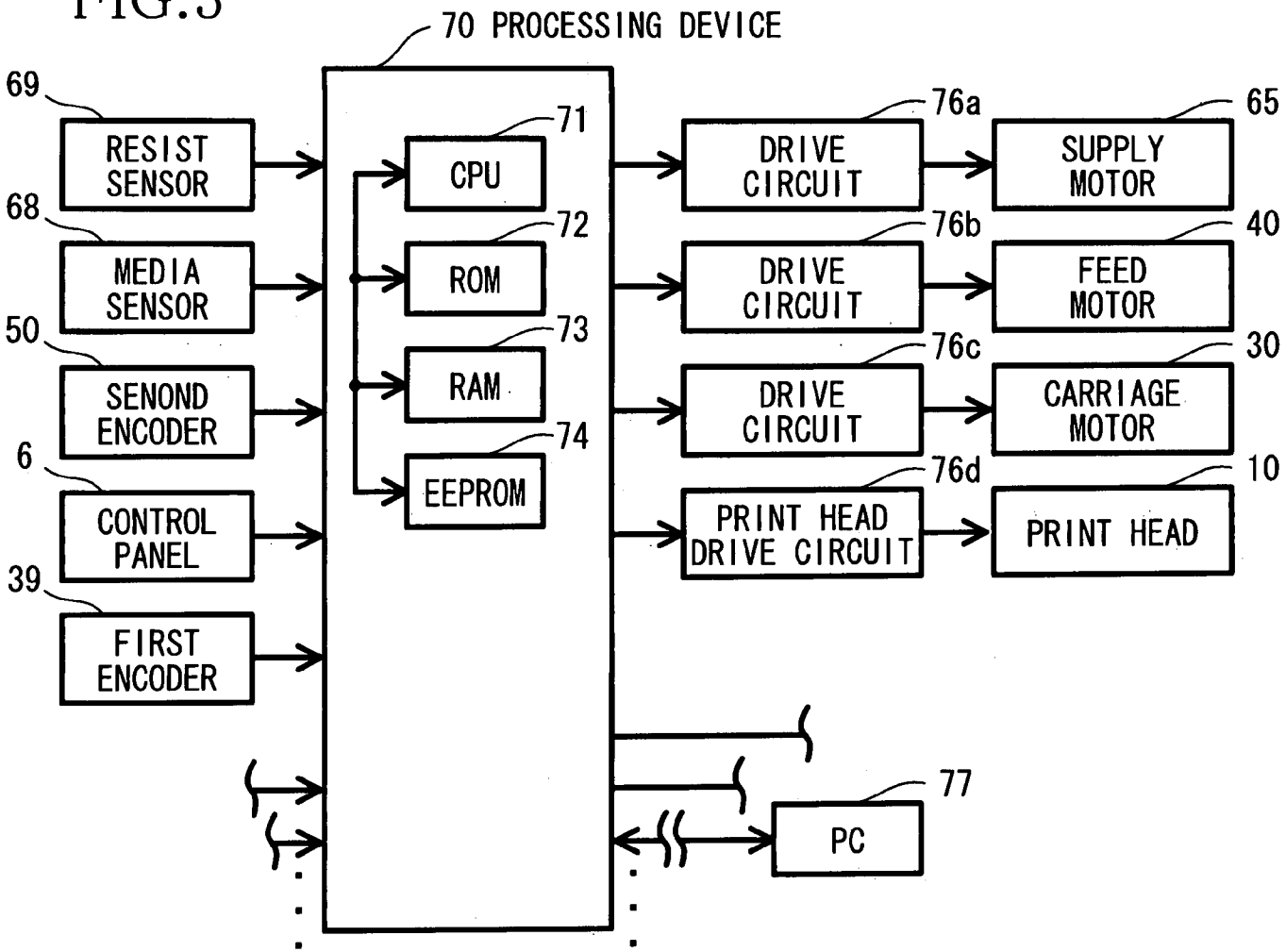
FIG. 3 is a block diagram representing a processing device of the multi-functional device.

A resist sensor 69 (not shown in FIG. 2(A), but shown in FIG. 3) is provided upstream from the media sensor 68 in a sheet feed direction (behind the media sensor 68) for detecting the absence or presence of a sheet or a leading edge or a trailing edge of a sheet. More specifically, the resist sensor 69 is attached at a front end of an upper cover that forms a sheet-feed path for the sheet-supply device 2.

For example, the resist sensor 69 comprises a detector protruding towards the sheet-feed path that is pivoted by a sheet being fed, a photo-interrupter, including a light-emitting portion and a light-receiving portion, for detecting the pivoting movement of the detector, and a mechanical sensor, including a torsion spring, which urges the detector towards the sheet-feed path. An interrupting portion is provided integrally with the detector. As the sheet being fed pivots the detector, the interrupting portion is moved away from a space between the light-emitting portion and the light-receiving portion of the photo-interrupter. Therefore the light transmission from the light emitting portion to the light receiving portion is not interrupted, and the resist sensor 69 is turned ON. When a sheet is not fed and the detector is urged by the torsion spring towards the sheet-feed path, the interrupting portion is located between the light emitting portion and the light receiving portion. At that time, the light transmission from the light emitting portion to the light receiving portion is interrupted, and the resist sensor 69 is turned OFF.

Figure 2B:
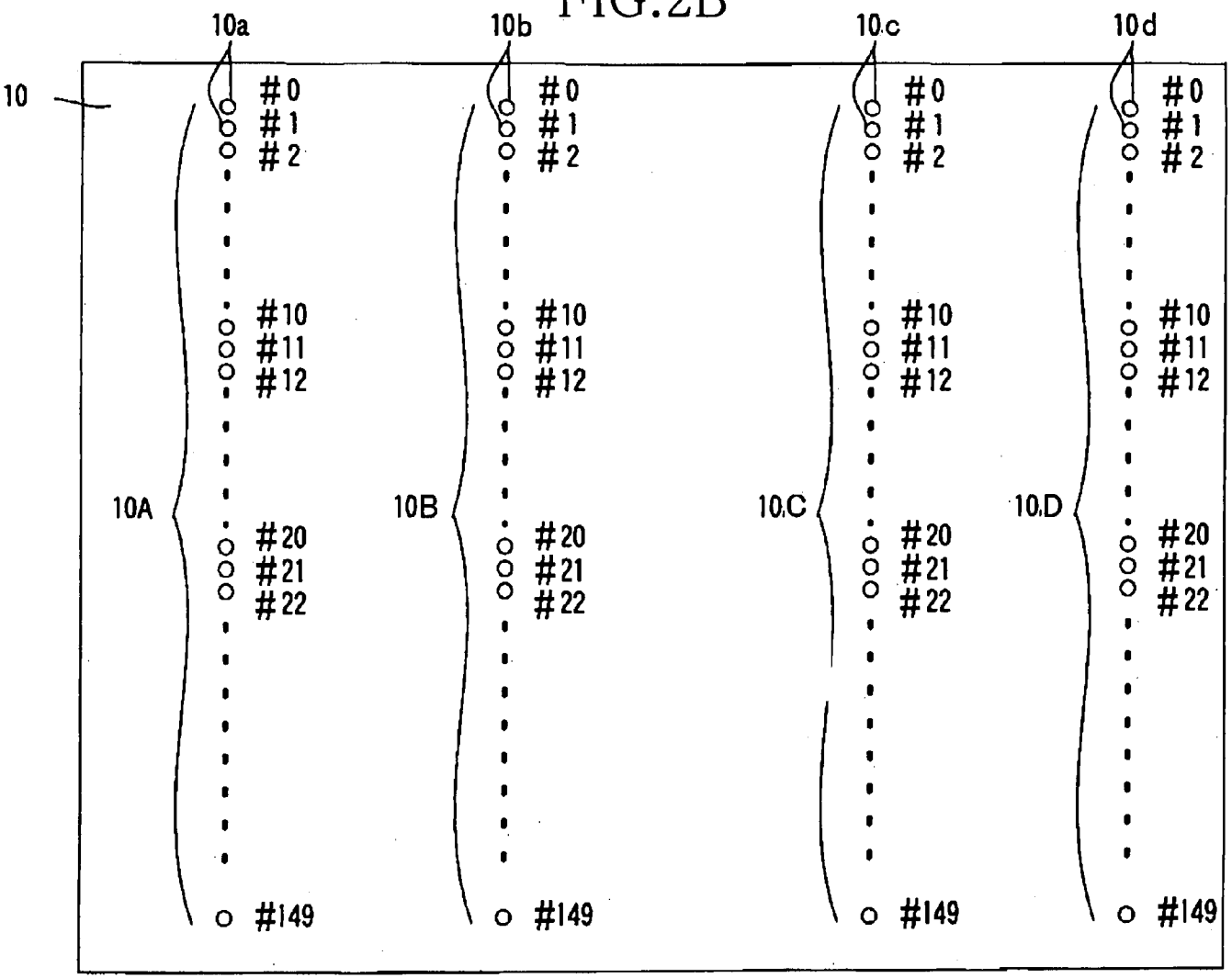
FIG. 2(B) shows an arrangement of ink nozzles of the print-head.

The maintenance mechanism 15 includes a wiper 15*a*, which wipes a head surface of the print head 10, two caps 15*b*, each being capable of sealing hermetically two groups out of the four groups 10A, 10B, 10C and 10D of ink nozzles (FIG. 2(B)), respectively, and a drive motor 15*c*, which drives the wiper 15*a* and the caps 15*b*. A mounting board 15*d*, mounting the wiper 15*a*, the caps 15*b*, and the drive motor 15*c*, is fixed to a right, bottom part of the frame 16.

The four groups 10A, 10B, 10C and 10D of ink nozzles (an ink nozzle corresponds to a printing element in the invention) are provided downwardly in the print head 10. The print head 10 is capable of forming images on a sheet by ejecting four different colors of ink (black, cyan, yellow, magenta) downwardly from the four groups 10A, 10B, 10C and 10D of ink nozzles. More specifically, one of four different colors of ink is ejected from one of the four groups 10A, 10B, 10C and 10D.

In FIG. 2(A), the caps 15 and the four groups 10A, 10B, 10C and 10D of ink nozzles are represented by dotted lines as images which would be seen if the print head 10 were transparent, although they can not be seen from the top, because they are provided on the underside of the print head 10. As shown in FIG. 2(A), the four groups 10A, 10B, 10C and 10D of ink nozzles are arranged in order in the direction that the carriage 11 moves. Each of the groups has ink nozzles 10*a*, 10*b*, 10*c* and 10*d* arranged in a direction that a sheet is fed, as shown in FIG. 2(B). FIG. 2(B) represents an enlarged view of the ink head 10. Ink nozzles belonging to the same group eject the same color ink. The number of the ink nozzles 10*a*, 10*b*, 10*c* and 10*d* of each group is, for example, one hundred and fifty. The ink nozzles 10*a*, 10*b*, 10*c* and 10*d* are not necessarily arranged in the sheet feed direction, but can be arranged in a direction inclined to some extent with respect to the sheet feed direction.

Because the groups 10A, 10B, 10C, and 10D are arranged in the direction that the carriage 11 moves, each of the ink nozzles 10*a*, 10*b*, 10*c*, and 10*d* having the same sequence number as shown in FIG. 2(B) are arranged in the direction that the carriage 11 moves. The ink nozzles are not necessarily precisely arranged in the direction that the carriage 11 moves, but can be arranged in a direction inclined to some extent with respect to the direction that the carriage 11 moves.

Next, the processing device 70 will be described. FIG. 3 is a block diagram which schematically depicts the structure of the processing device 70. As shown in FIG. 3, the processing device 70 is provided with a microcomputer including a central processing unit (CPU) 71, a read only memory (ROM) 72, a random access memory (RAM) 73, and an electrically erasable programmable read only memory (EEPROM) 74. The processing device 70 is electrically connected to the resist sensor 69, the media sensor 68, the second encoder 50, the control panel 6, and the first encoder 39.

The processing device 70 is also electrically connected to drive circuits 76*a*–76*c* for driving the supply motor 65, the feed motor 40 and carriage motor 30 respectively. The processing device 70 is also connected to a print head drive circuit 76*d* for driving the print head 10. The processing device 70 is capable of being connected to a host device, such as a personal computer (PC) 77.

The CPU 71 temporarily stores printing data, sent from the PC 77, in the RAM 73, and converts the printing data stored in the RAM 73 to image data according to programs previously stored in the ROM 72. The CPU 71 drives the supply motor 65, the feed motor 40, and the carriage motor 30 by sending drive signals to the drive circuits 76*a*–76*c*, respectively, based on detection signals from the resist sensor 69, the media sensor 68, the second encoder 50, and the first encoder 39. The CPU 71 also drives the print head 10 by sending a drive signal to the print-head drive circuit 76*d* based on the image data.

As a voltage is applied to a piezoelectric actuator (not shown) provided to a cavity, the cavity is deformed, and ink inside the cavity is pushed out of the associated nozzle. Thus, ink is ejected, based on the image data out of each appropriate ink nozzle 10*a*, 10*b*, 10*c* and 10*d*.

Figure 4:
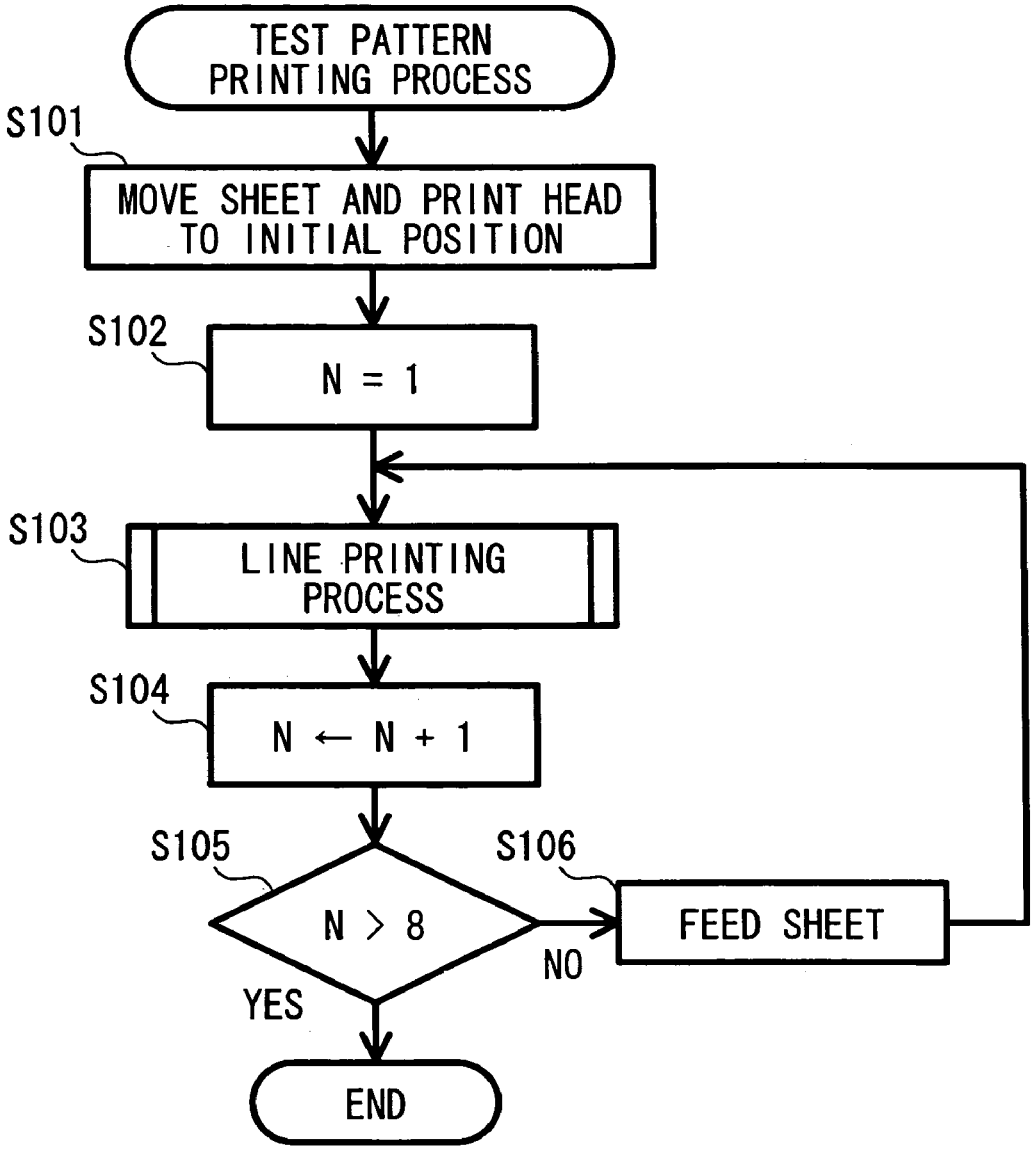
FIG. 4 is a flowchart representing a test pattern printing process.
Figure 5:
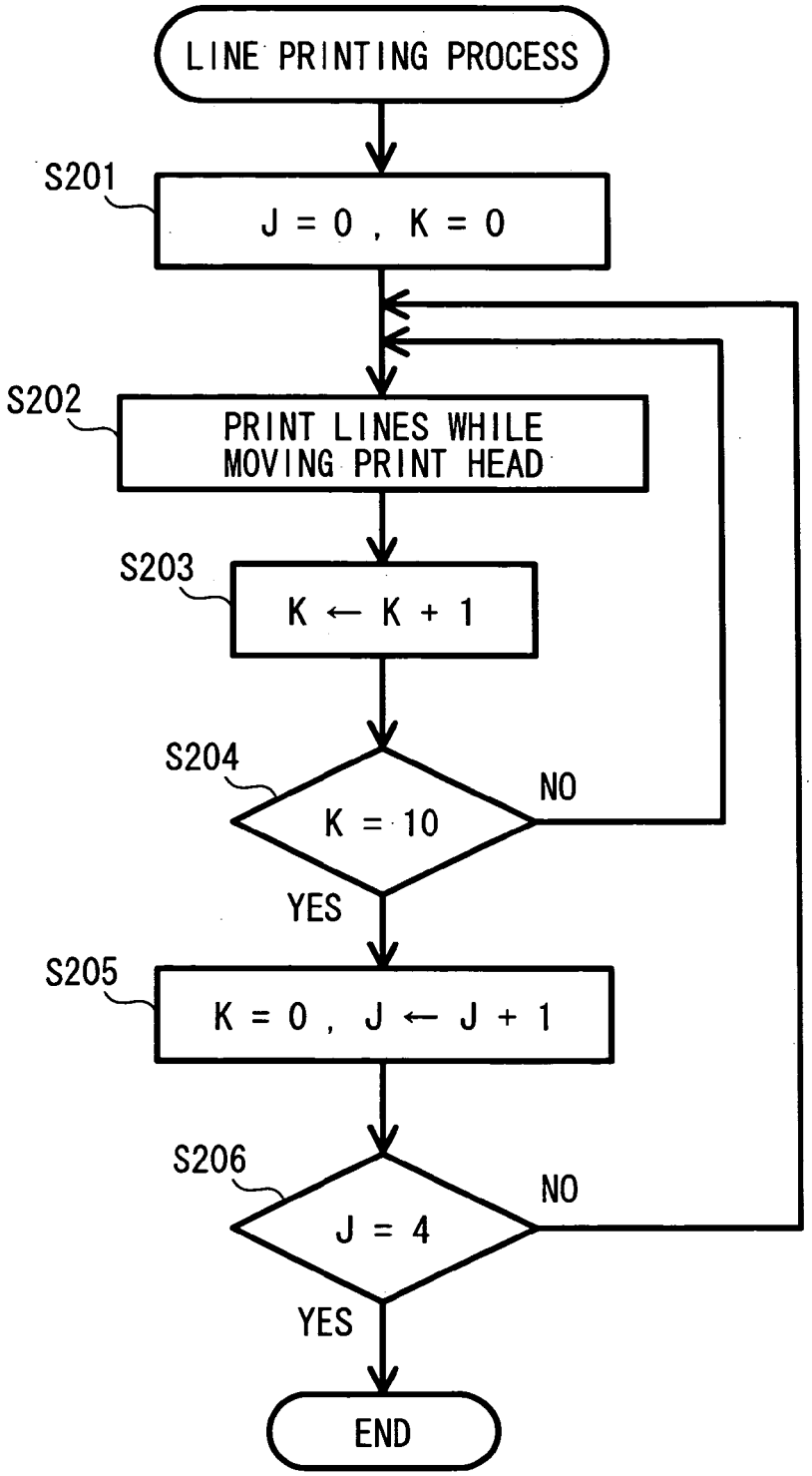
FIG. 5 is a flowchart representing a line printing process.
Figure 6:
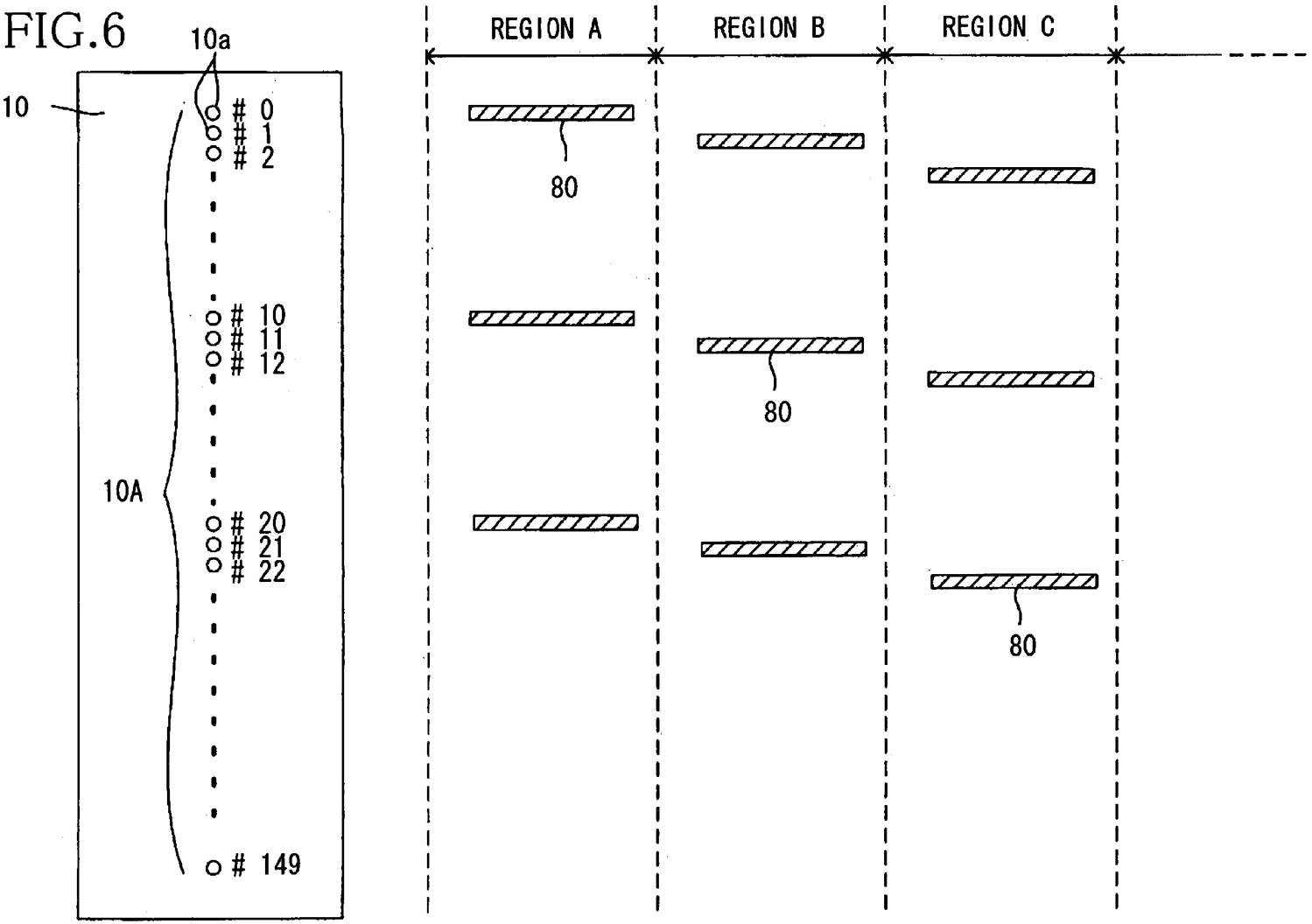
FIG. 6 is an diagram showing an example of dot lines printed by a line printing process.
Figure 7:
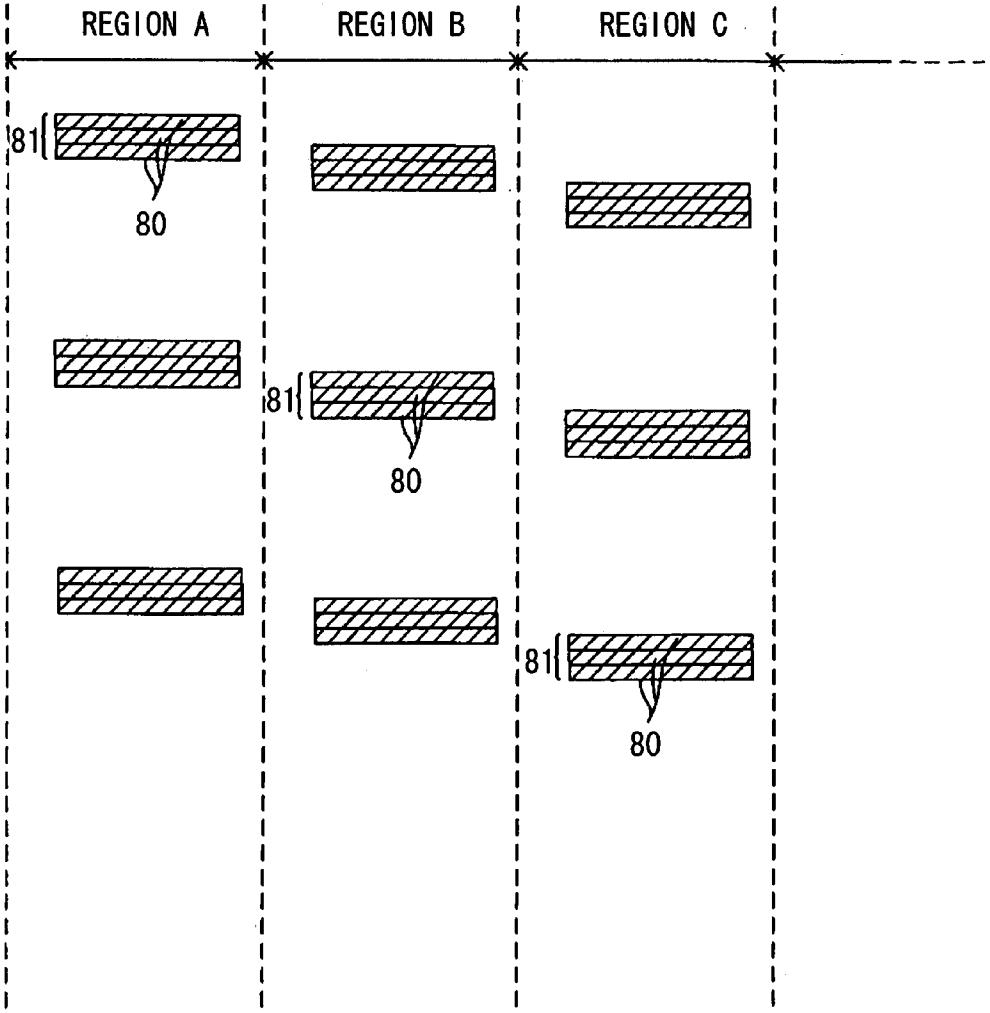
FIG. 7 is an diagram showing an example of incomplete plane images printed by a test pattern printing process.
Figure 8:
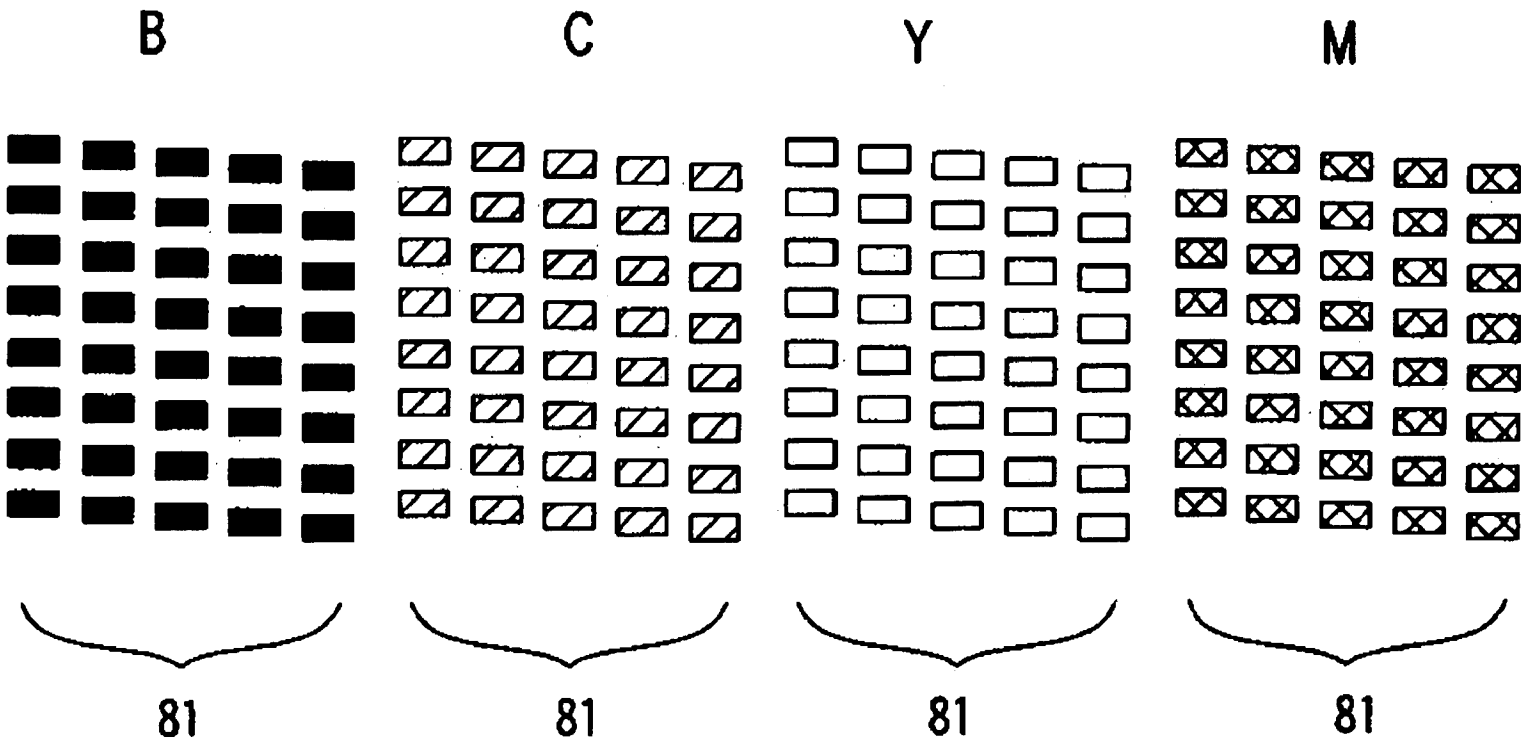
FIG. 8 is a diagram showing an example of plane images printed by a test pattern printing process.

Next, a method of printing a test pattern, by operating the multi-functional device thus structured, for checking whether each ink nozzle 10*a*, 10*b*, 10*c* and 10*d* ejects ink correctly, will be described with reference to FIGS. 4 through 8. FIG. 4 is a flowchart representing a test pattern printing process to be executed by the processing device 70. FIG. 5 is a flowchart representing a line printing process to be executed by the processing device 70. FIG. 6 is a diagram showing first incomplete plane images printed by a line printing process. FIG. 7 is a diagram showing second incomplete plane images printed by a test pattern printing process, and FIG. 8 is a diagram showing complete plane images printed by a test pattern printing process. Although the multi-functional device is provided with ink nozzles 10*a*, 10*b*, 10*c* and 10*d* for four different colors of ink in this embodiment, test patterns are shown as printed by only one (black) of the four different colors of ink in FIGS. 6 and 7 for the clarity of explanation. Printing of the plane images are executed, for example when a user presses a predetermined key on the control panel 6.

In S101 (FIG. 4), the processing device 70 drives feed motor 40 and carriage motor 30 to move a sheet and the print head 10 to an initial position, respectively. Next in S102, a repetition number N is set to one, and then the flow proceeds to a line printing process of S103. The repetition number N represents the number of times S103 of the flow is currently executing.

FIG. 5 shows the line printing process of S103. An ink-color number J (O through 3) and an ink-nozzle number K (O through 9) are allotted to each ink nozzle 10*a*, 10*b*, 10*c* and 10*d*. In S201, as initial values, J=O and K=O are stored in the RAM 73. Here, J=O corresponds to black (B), J=1 to cyan (C), J=2 to Yellow (Y), and J=3 to magenta (M). As mentioned above, the number of ink nozzles 10*a*, 10*b*, 10*c*, and 10*d* of each group is one hundred and fifty. Sequence numbers from #0 to #149 are allotted to each nozzle 10*a*, 10*b*, 10*c* and 10*d* in order from one end of each group 10A, 10B, 10C and 10D to the other end in a direction that a sheet is fed (FIG. 2(B)). The ink nozzles 10*a*, 10*b*, 10*c* and 10*d* of each group 10A, 10B, 10C and 10D are divided into fifteen blocks of ten nozzles each in order from one end of each group 10A, 10B, 10C and 10D to the other end. The first block of each group 10A, 10B, 10C and 10D includes ten nozzles #0 through #9. The second block of each group 10A, 10B, 10C and 10D includes ten nozzles #10 through #19. Similarly, the last, or fifteenth, block of each group 10A, 10B, 10C and 10D includes ten nozzles #140 through #149. The ink-nozzle number K represents a last digit of the sequence numbers allotted to each nozzle 10*a*, 10*b*, 10*c* and 10*d* of each group 10A, 10B, 10C and 10D. Therefore, K=0 represents fifteen nozzles of each group 10A, 10B, 10C and 10D, which are nozzles #0, #10, #20, - - - , and #140. K=1 represents fifteen nozzles of each group, which are nozzles #1, #11, #21, - - - , and #141. Similarly, K=9 represents fifteen nozzles of each group, which are nozzles #9, #19, #29, - - - , and #149.

Next, in S202, the processing device 70 prints dot lines 80 by driving each ink nozzle 10*a*, 10*b*, 10*c* and 10*d* specified by the values of the ink-color number J and the ink-nozzle number K stored in the RAM 73, while moving the print head 10 in a first direction of a sheet, that is, in a main scanning direction. When the values of the ink color number J and the ink-nozzle number K stored in the RAM 73 are both zero, black ink is ejected continuously for a predetermined period of time, from fifteen nozzles #0, #10, #20, - - - , and #140, each belonging to the group 10A. As a result, fifteen black dot lines 80 are printed in a region A of FIG. 6. In FIG. 6, each dot line 80 is depicted by an approximate rectangle; however, an actual dot line is a sequence of dots formed by ink droplets.

Next, one is added to the value of the ink-nozzle number K in S203. In S204, the processing device 70 judges the value of the ink-nozzle number K, that is, judges whether every nozzle, specified by the value of the ink color number J, has printed a dot line 80 once. When the ink-nozzle number K is not ten (S204: No), it means each ink nozzle, specified by the ink-nozzle number K under the condition that K=9, has not printed a dot line yet, and one is added to the value of the ink-nozzle number K in S203. As described above, in this embodiment, the ink nozzles 10*a*, 10*b*, 10*c* and 10*d* of each group 10A, 10B, 10C and 10D are divided into fifteen blocks of ten nozzles, therefore, when each ink nozzle specified by the ink-nozzle number K under the condition that K=9, has not printed a dot line yet, it means not every ink nozzle, specified by the value of the ink color number J, has printed a dot line yet. On the other hand, when the ink-nozzle number K is ten (S204: Yes), it means each ink nozzle, specified by the ink-nozzle number K under the condition that K=9, has already printed a dot line, that is, every ink nozzle specified by the value of the ink color number J, has already printed a dot line.

When the ink-nozzle number K is not ten (S204: No), the flow returns to S202, in which the processing device 70 prints dot lines by driving each ink nozzle 10*a*, 10*b*, 10*c* and 10*d* specified by the values of the ink color number J and the ink-nozzle number K stored in the RAM 73, while moving the print head 10 in the first direction. For example, when the ink color number J is zero and the ink-nozzle number K is one, fifteen nozzles #1, #11, #21, - - - , and #141, each belonging to the group 10A, print fifteen black dot lines 80's in a region B of FIG. 6. When the ink color number J is zero and the ink-nozzle number K is two, fifteen nozzles #2, #12, #22, - - - , and #142, each belonging to the group 10A, print fifteen black dot lines 80's in a region C of FIG. 6.

The flow thus repeats S202–S204. Once the processing device 70 determines that the value of ink-nozzle number K is ten (S204: Yes), the flow proceeds to S205, in which processing device 70 adds one to the value of ink-color number J, clears the value of ink-nozzle number K to zero, and stores the values in the RAM 73.

In S206, the processing device 70 judges the value of the ink-color number J, that is, the processing device 70 judges whether every nozzle specified by the ink-color number J (O through 3), has printed a dot line 80 once. When the ink-color number J is not four (S206: No), it means that ink nozzles 10*d* specified by the ink-color number J under the condition that J=3, has not printed a dot line yet, because one is added to the value of the ink-color number J in S205. As mentioned above, in this embodiment, four groups 10A, 10B, 10C and 10D of ink nozzles for four different colors are provided. Therefore, when ink nozzles 10*d* specified by the ink-color number J under the condition that J=3, has not printed a dot line yet, it means that not every ink nozzle 10*a*, 10*b*, 10*c* and 10*d* of the four groups 10A, 10B, 10C and 10D has printed a dot line. On the other hand, when the ink-color number J is four (S206: Yes), it means that every ink nozzle 10*a*, 10*b*, 10*c* and 10*d* of the four groups 10A, 10B, 10C and 10D has printed a dot line.

Accordingly, when the value of the ink-color number J is not four (S206: No), the flow returns to S202, in which the processing device 70 prints dot lines by driving each ink nozzle 10*a*, 10*b*, 10*c* and 10*d* specified by the values of the ink-color number J and the ink-nozzle number K stored in the RAM 73, while moving the print head 10 in the first direction. For example, when the ink-color number J is one and the ink-nozzle number K is zero, fifteen nozzles #0, #10, #20, . . . , #140, each belonging to the group 10B, print fifteen dot lines 80's with cyan ink.

On the other hand, when the value of the ink-color number J is four (S206: Yes), the line printing process shown in FIG. 5 ends. At this stage, every ink nozzle 10*a*, 10*b*, 10*c* and 10*d* has finished printing a dot line once. Then, the flow proceeds to S104 of the test-pattern printing process-shown in FIG. 4.

In S104, one is added to the value of the repetition number N, and the value is stored in the RAM. In S105, the processing device 70 judges whether the value of the repetition number N is larger than a predetermined number or a number input from the control panel 6. In this embodiment, the processing device 70 judges whether the value of the number N is larger than eight. When the value of the number N is equal to or smaller than eight, the flow proceeds to S106, in which the processing device 70 feeds a sheet one dot line in a second direction, although the advance need not be exactly one dot line, perpendicular to the first direction, such that an ink nozzle can print a dot line adjacent to a dot line printed previously, and then the flow proceeds to S103.

As long as the value of the number N is equal to or smaller than eight, the flow repeats S103 through S106. While the flow repeats S103 through S106, as shown in FIG. 7, the processing device 70 repeats printing dot lines 80 adjacent to dot lines 80 printed previously, and thereby forms plane images 81.

When the value of the number N is larger than eight in S105, the test pattern printing process ends. The test pattern printing process is thus executed. At this stage, the test pattern, as shown in FIG. 8 has been printed on a sheet. As the number of ink nozzles of each group 10A, 10B, 10C and 10D is one hundred and fifty, and the ink nozzles are divided into fifteen blocks often ink nozzles each, each color test pattern must be composed of one hundred and fifty plane images 81, fifteen plane images 81 being arranged in a longitudinal, i.e., vertical or subscanning. direction and ten being arranged in a lateral, horizontal or main scanning. direction. However, in FIG. 8 and in the following figures, for the clarity of explanation, the test pattern is simplified such that each color test pattern is composed of forty plane images 81, eight being arranged in a longitudinal direction and five being arranged in a lateral direction.

According to above-described test pattern printing method, the multi-functional device 1 of this embodiment does not merely print a single dot line 80, but prints a test pattern including plane images 81, each having a larger area, by repeating the line printing process in which single dot lines 80 are printed.

By observing the test pattern thus printed, it is possible to judge easily whether each ink nozzle 10*a*, 10*b*, 10*c* and 10*d* is clogged. Also, the large area of the plane image 81 improves the accuracy of an automatic judgment by a reading device 4, such as a scanner.

Although, as discussed above, each print line is started at the same end of the line, reciprocal printing can be used. If reciprocal printing is used, when line printing is conducted for the selected ink nozzles, the order of printing is in reverse order, i.e., in standard left to right printing the print order is nozzles #0, #10, #20, . . . , #140 to #9, #19, #29, . . . , #149, whereas after the recording medium has been advanced one dot line in the second direction, although the advance need not be exactly one dot line, the next line of each plane image 81 is printed in reverse from right to left. This printing starts with nozzles #9, #19, #29, . . . , #149 at the right and finishes with nozzles #0, #10, #20, . . . , #140 at the left. The next line is printed left to right and so on until N lines have been printed.

Furthermore, the print head 10 is provided with the groups 10A, 10B, 10C and 10D of ink nozzles 10*a*, 10*b*, 10*c* and 10*d* for different kinds of color ink. The groups. 10A, 10B, 10C and 10D of ink nozzles are separated from each other in a direction approximately parallel to the first direction. The processing device 70 changes the group 10A, 10B, 10C and 10D of ink nozzles to be driven, while the print head 10 is printing dot lines 80 in the first direction, to thereby form each color plane images 81.

According to the above-described arrangement, it is possible to print every color dot line 80, while the print head 10 is moving in the first direction, and to arrange every color plane image 81 in the first direction. Thus, a printing time is shorter in comparison with a case where the groups are separated from each other in the second direction perpendicular to the first direction.

As described above, the multi-functional device 1 also has one hundred fifty ink nozzles 10*a*, 10*b*, 10*c*, and 10*d* in the print head 10, the ink nozzles being separated from each other in a direction approximately parallel to the second direction. The one hundred fifty ink nozzles 10*a*, 10*b*, 10*c*, 10*d* are divided into fifteen blocks of every adjacent ten ink nozzles. One nozzle from each block is selected, and the selected ink nozzles ate driven simultaneously. The ink nozzles selected and driven are changed in order from one end of each block to the other, thereby printing dot lines 80 simultaneously.

According to the above-described arrangement, the multi-functional device 1 prints fifteen dot lines 80 simultaneously while the print head 10 is moving in the scanning direction, by driving fifteen ink nozzles simultaneously, each nozzle being separated by ten nozzles from each adjacent printing or driven nozzle. It is therefore possible to reduce printing time for the test. Especially, as the ink nozzles are changed in order from one end of each block to the other, plane images printed by printing elements belonging to each one of the blocks are arranged in a certain direction, thereby forming a column, and plane images printed simultaneously are arranged in a direction approximately parallel to the second direction, thereby forming a row, the columns and the rows forming a matrix. The matrix-shape makes it easier to compare the print condition of the plane image with adjacent patterns, and improves visibility of the plane image.

A parallelogram plane image, especially a substantially rectangular plane image 81 as shown in FIG. 8, is formed when each dot line is printed while ink nozzles 10*a*, 10*b*, 10*c* and 10*d* are driven in a fixed condition under which a driving waveform, a driving voltage, a driving frequency or the like, controlled by the processing device is fixed. By examining the concentration or gradation of the plane image thus formed, it is possible to check the amount of ejected ink and ejecting ability.

According to the above-described test pattern printing process, the visibility of the test pattern 81 is improved. In order to improve the visibility even more, it is preferable to execute a background printing process in which a background is printed to the plane images printed by yellow ink, the brightest in this embodiment, in addition to the test pattern printing process.

Figure 9:
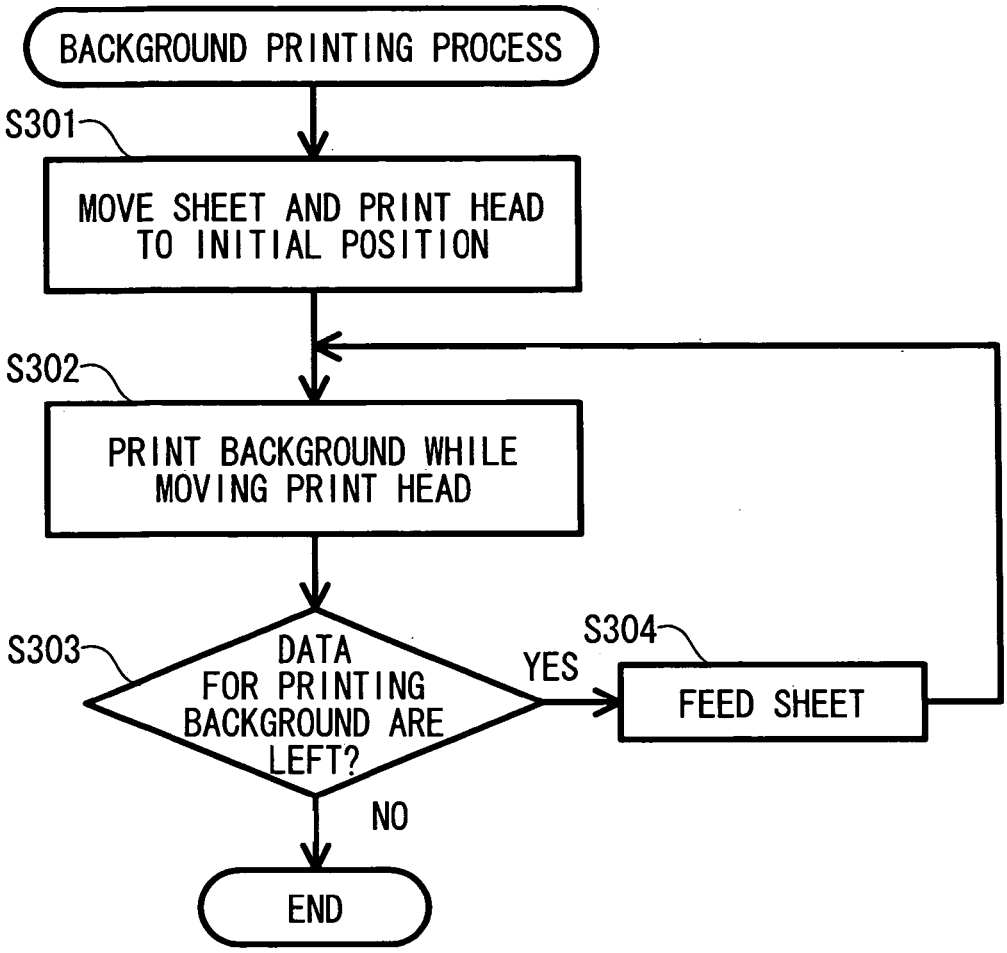
FIG. 9 is a flowchart representing a background printing process.

In FIG. 9, a flowchart representing the background printing process executed by the processing device 70, is shown. In S301, the processing device 70 drives feed motor 40 and carriage motor 30 to move a sheet and the print head 10 to an initial position respectively. Next, in S302, the processing device prints a background 83 with cyan ink on an area where yellow plane images 81 are printed.

Next, in S303, the processing device 70 judges whether the printing of the background 83 with cyan ink is finished. When image data for printing the background are left in the RAM 73, the flow proceeds to S304, in which the processing device 70 feeds the sheet a predetermined distance, and then the flow returns to S302. When image data for printing the background is not left in the RAM 73, the background printing process ends.

Figure 10A:
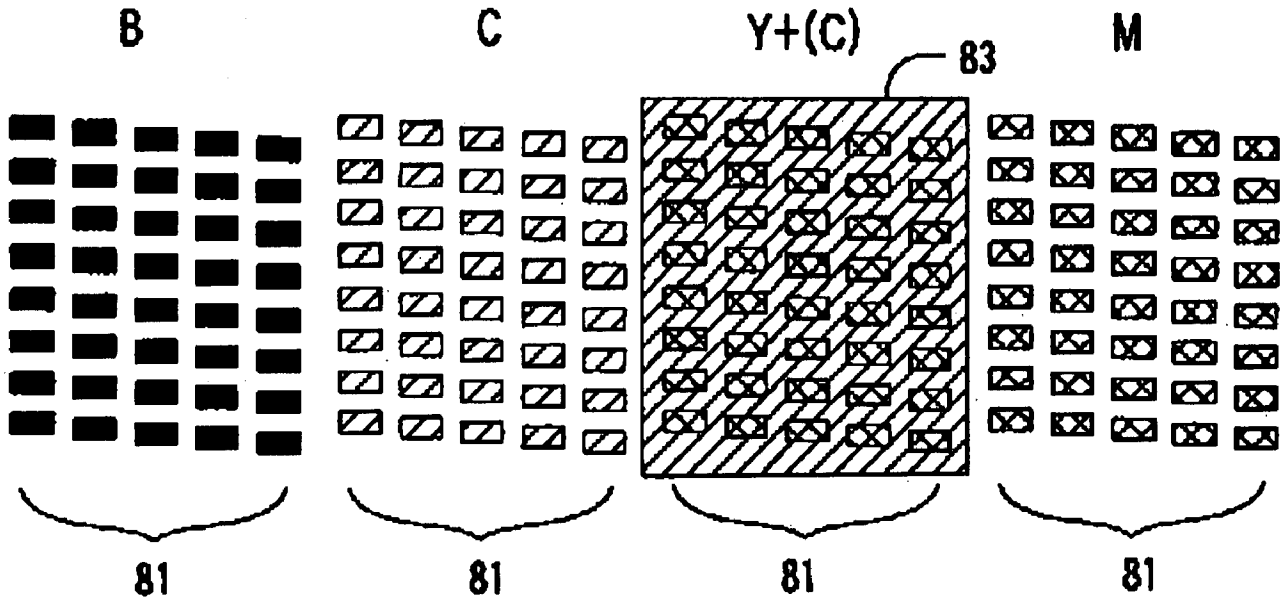
FIGS. 10(A), 10(B) and 10(C) are diagrams showing examples of plane images printed by a test pattern printing process and a background printing process.

After the background is printed completely on the sheet, a user can discharge the sheet from the discharge opening 8 and supply the discharged sheet again from the sheet supply opening 2. Following the supply of the sheet, by executing the test pattern printing process, a test pattern is printed on the background previously printed on the supplied sheet. Thus, a test pattern as shown in FIG. 10(A) is formed. After the background is printed completely on the sheet, instead of discharging the sheet from the discharge opening 8, the processing device 70 can feed the sheet in reverse, or to the upstream side, in the second direction, that is, towards sheet supply device 2 until the sheet reaches the initial position described above in S101. Following the reverse feeding of the sheet, by executing the test pattern printing process, a test pattern, as shown in FIG. 10(A), is also formed. Moreover, instead of executing the test pattern printing process after executing the background printing process, the background printing process can be executed after executing the test pattern printing process to substantially form a test pattern as shown in FIG. 10(A).

Visibility of plane images printed with bright ink, such as yellow, in this embodiment might be low, and it might be difficult to judge whether the plane images are printed correctly. However, when the plane images 81 are printed with the background 83, it is possible to improve the visibility by mixing two kinds of ink, such as yellow ink and cyan ink, in this embodiment, because the mixed color is less bright than yellow.

Figure 10B:
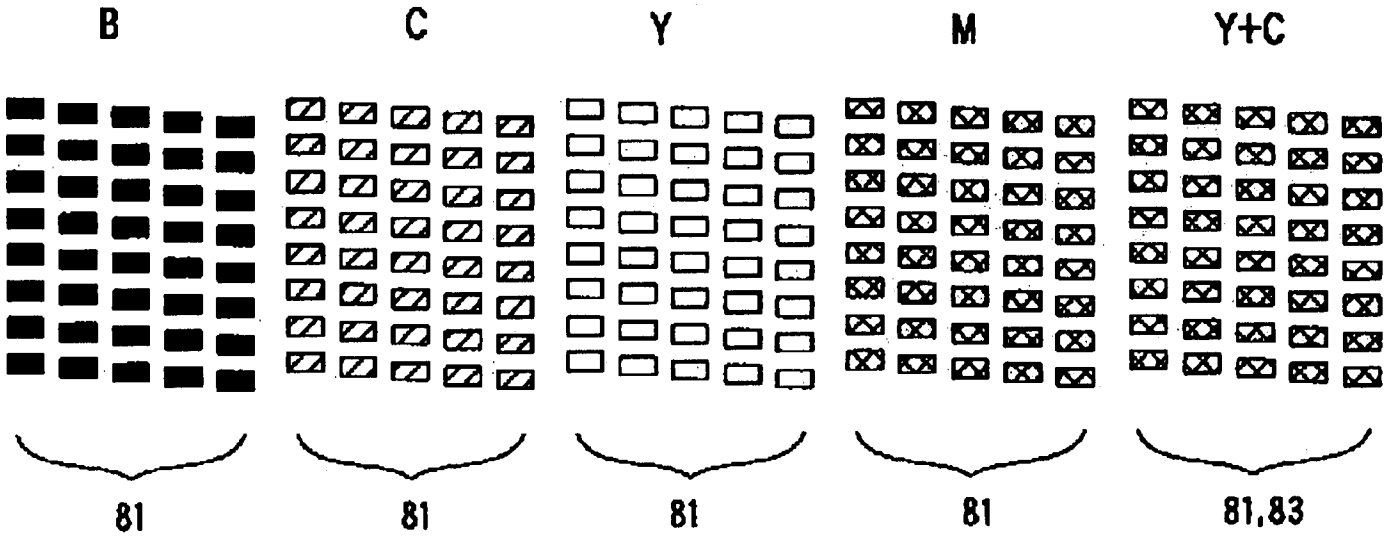
Figure 10C:
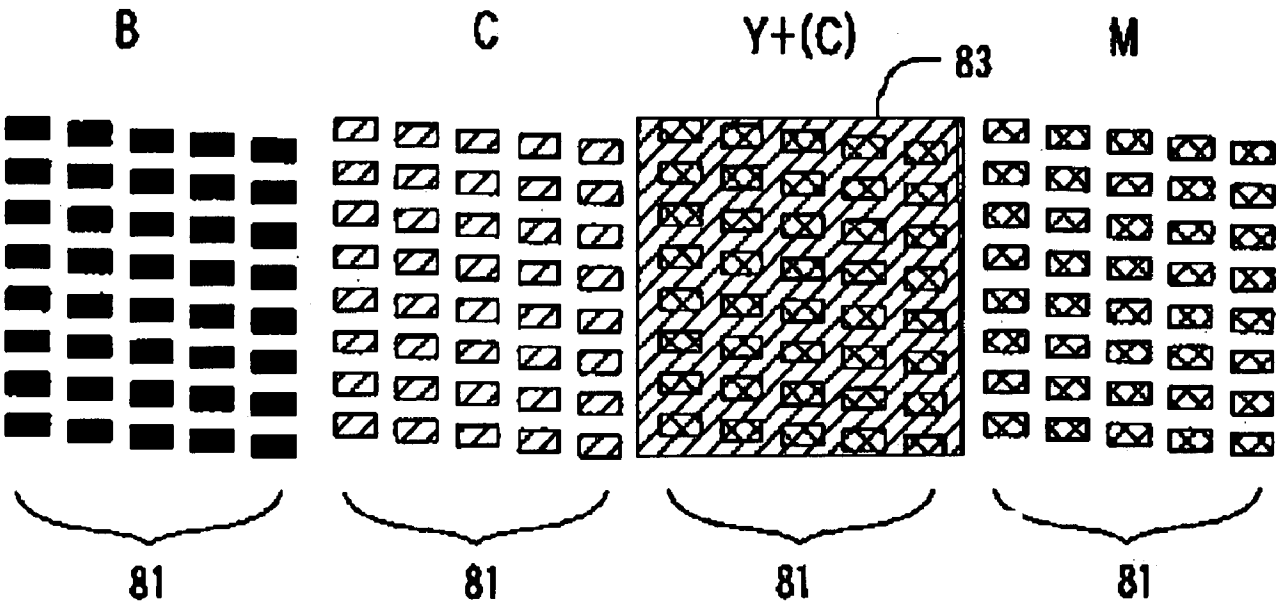
Figure 11:
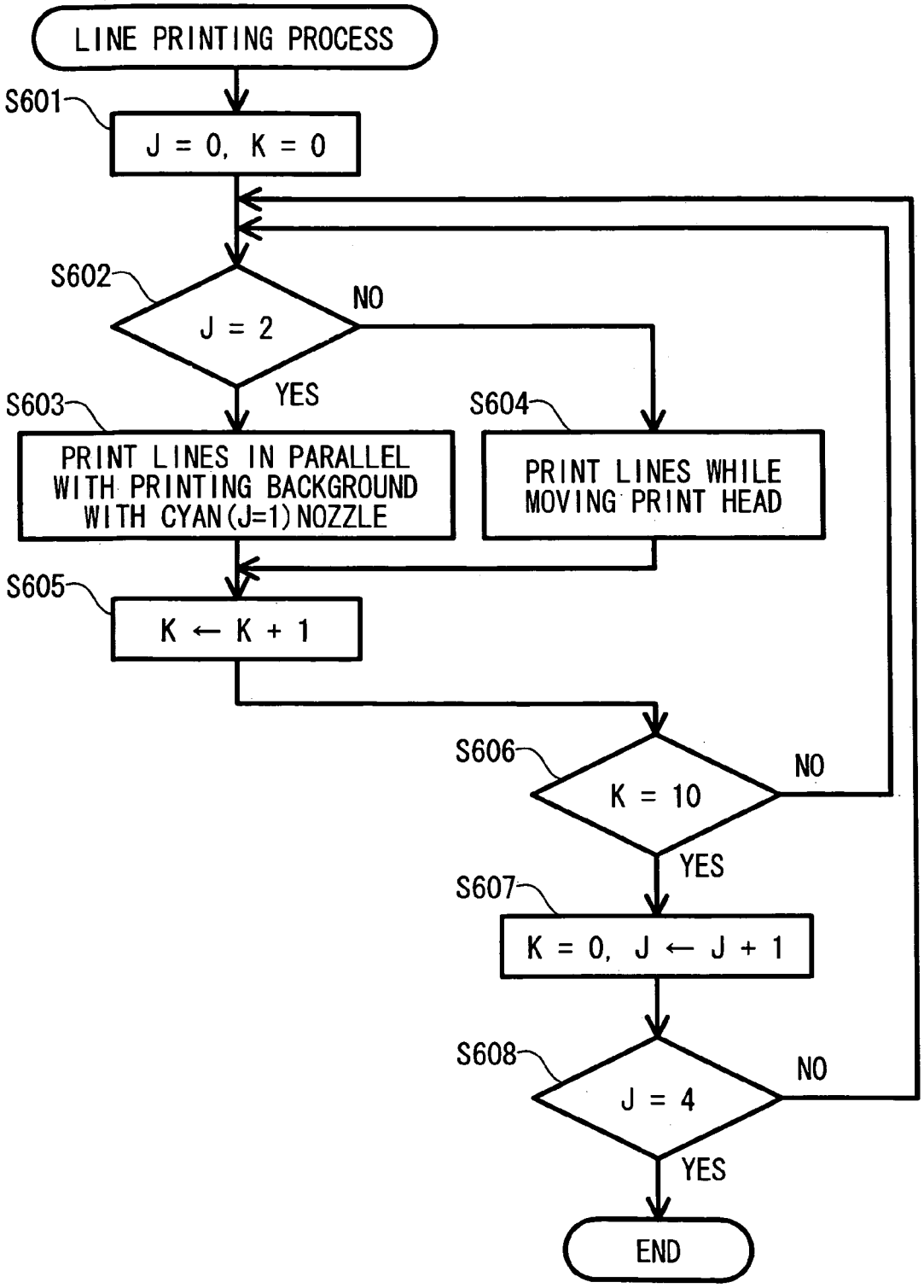
FIG. 11 is a flowchart representing a line printing process according to a modified embodiment.

Although the test pattern printing process and the background printing process can be executed independently as described above, another embodiment is to print a background 83 in parallel with printing dot lines 80 by revising the line printing process of the test pattern printing process as shown in FIG. 11. The line printing process shown in FIG. 11 is the same as that shown in FIG. 5 except that S202 is replaced with steps of S602–S604. In FIG. 11, the processing device 70 judges whether the ink color number J is two (J=2 corresponds to yellow in this case). When the ink color number J is two (S602: YES), in S603, the processing device 70 prints dot lines 80 by driving each ink nozzle 10*a*, 10*b*, 10*c* and 10*d* specified by the values of the ink-color number J and the ink-nozzle number K stored in the RAM 73, while moving the print head 10 in the first direction of a sheet in the same manner as in FIG. 5 and, at the same time, the processing device 70 prints a background 83 with cyan ink. The time point where the printing of the background 83 is started and the time point where the printing of the background 83 is finished are not necessarily equal to the time point where the printing of the dot lines 80 is started and the time point where the printing of the dot lines 80 is finished, respectively. For example, the printing of the background 83 can be finished after a predetermined interval from when the printing of the dot lines 80 is finished. When the ink color number J is not two (S602: NO), in S604, the processing device 70 prints dot lines 80 by driving each ink nozzle 10*a*. 10*b*, 10*c* and 10*d* specified by the values of the ink-color number J and the ink-nozzle number K stored in the RAM 73, while moving the print head 10 in the first direction of a sheet in the same manner as in FIG. 5. S605 through S608 are the same as S203 through S206 in FIG. 5. By thus executing the test pattern printing process, a test pattern as shown in FIG. 10(C) is formed.

It is also preferable to print test patterns on two different areas according to the test pattern printing process, and to print a background on one of the two different areas according to the background printing process. For example, in S201 of the line printing process shown in FIG. 5, yellow and cyan are related to the color number J=4, the processing device judges whether the color number is five in S206, and S202 through S206 are repeated until the color number J becomes five. When the color number J is two, only yellow plane images 81 are printed. When the color number J is four, yellow plane images 81 are printed with a cyan background 83.

Moreover, a cyan background 83 can be printed only on the position where each yellow plane image is printed in S302 of the background printing process shown in FIG. 9. When the test pattern printing process and the background printing process are thus executed, the test pattern show in FIG. 10(B) is formed.

When test patterns are printed on two different areas and a background is printed on one of the two different areas, it is possible to judge which printing element is clogged in the case where the mixed color plane images have defects, by examining the test pattern printed using the single ink.

It is also preferable to execute an information printing process, in which an identification number is printed to identify the printing element which printed each plane image in the test pattern printing process.

Figure 12:
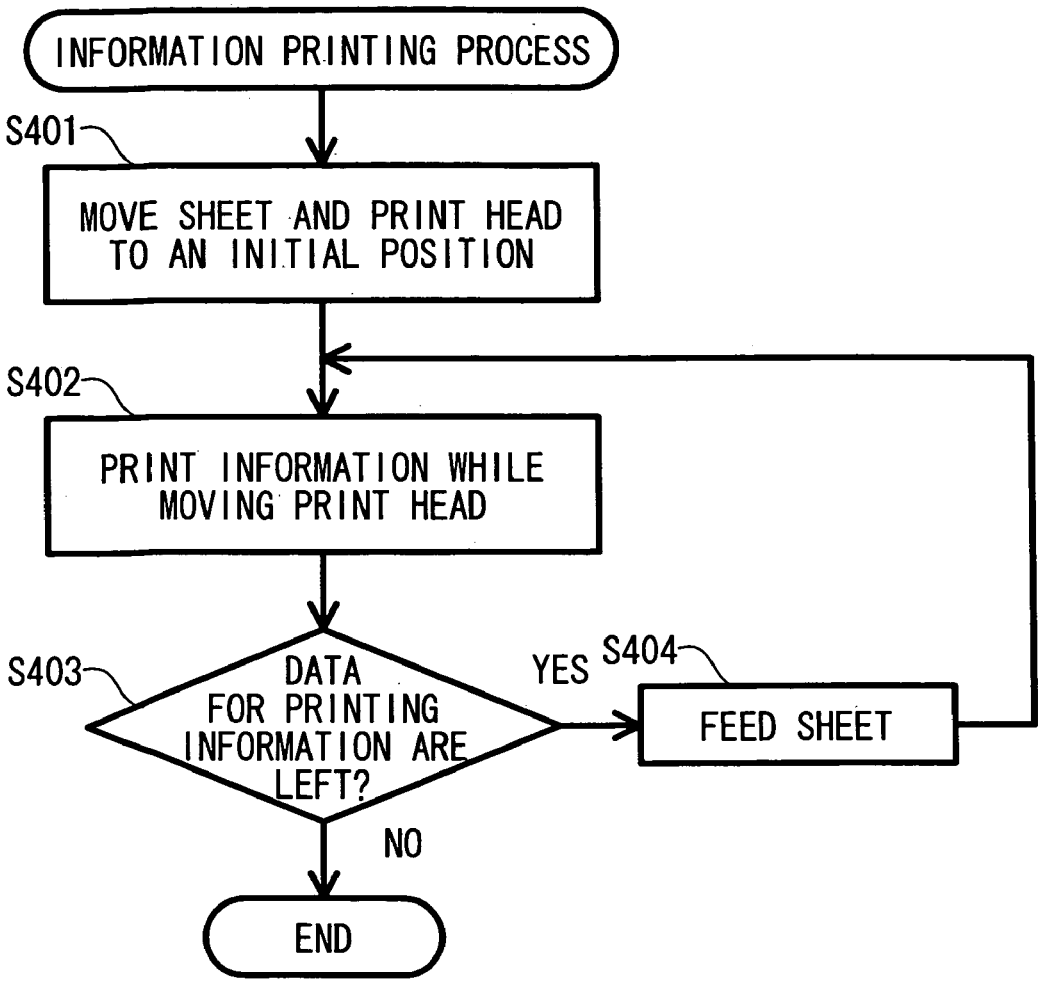
FIG. 12 is a flowchart representing an information printing process.

In FIG. 12, a flowchart representing the information printing process to be executed by the processing device 70 is shown. First, the processing device 70 drives feed motor 40 and carriage motor 30 to move a sheet and the print head 10 to an initial position, respectively. Next, in S402, an identification number is printed close to an individual plane image 81. Next, in S403, the processing device 70 judges whether all identification numbers have been printed. When image data for printing identification numbers are left in the RAM 73, the flow proceeds to S404, in which a sheet is fed by a predetermined distance. When the image data for printing identification numbers is not left in the RAM 73, the information printing process ends.

Figure 13:
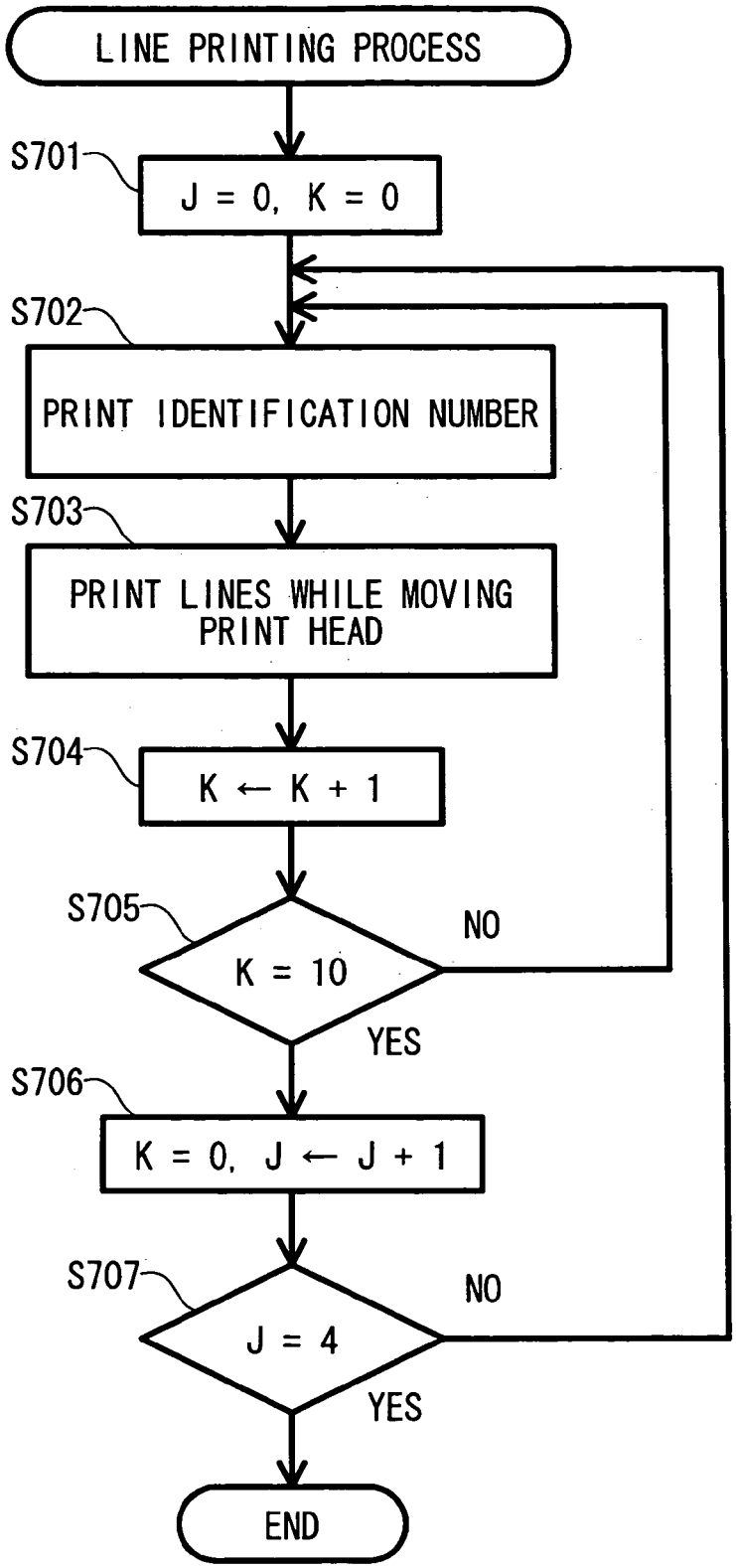
FIG. 13 is a flowchart representing a line printing process according to a modified embodiment.
Figure 14:
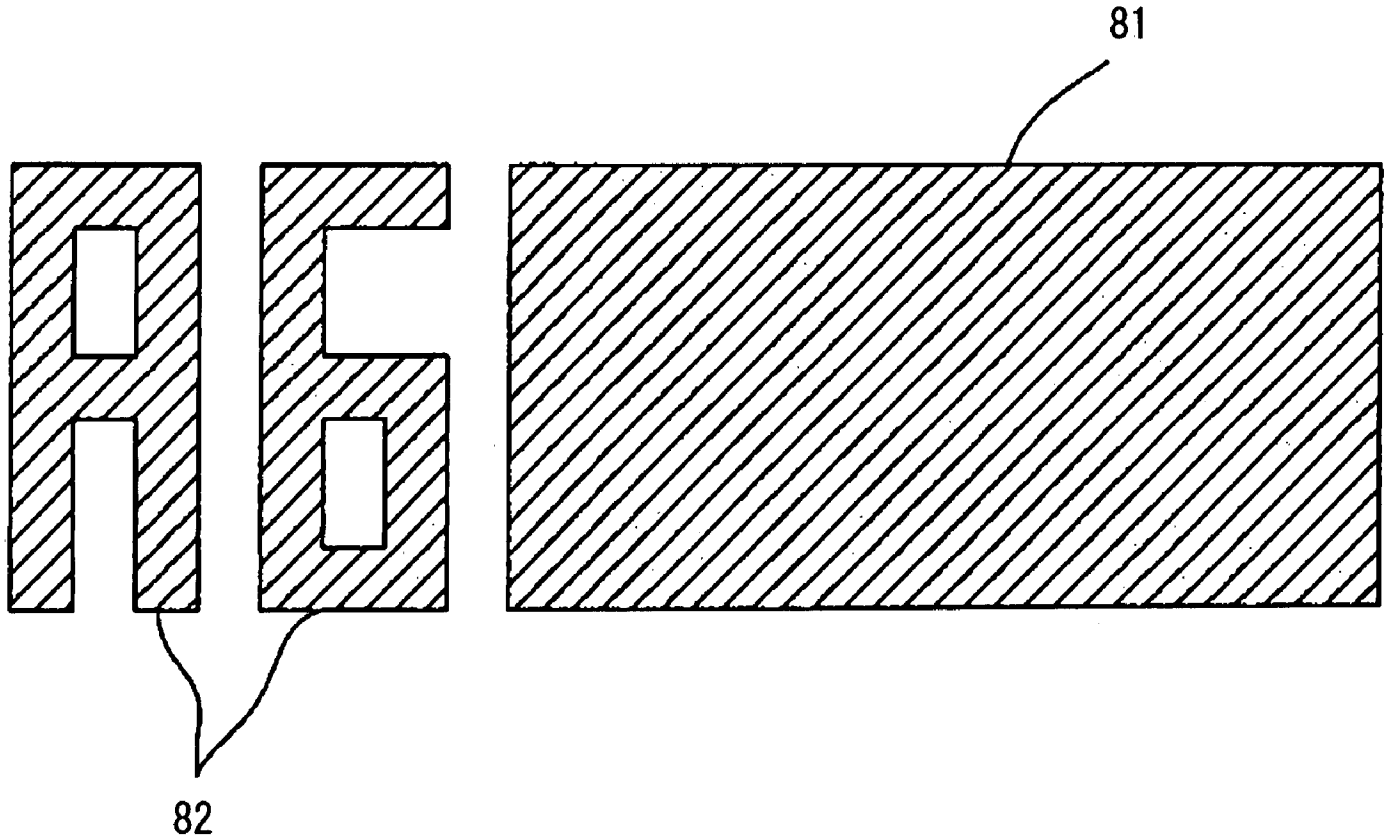
FIG. 14 is a diagram showing an example of a plane image printed by a test pattern printing process and an information printing process.

Although the test pattern printing process and the information printing process can be executed independently as described above, another embodiment is to print an identification number before printing dot lines 80 by revising the line printing process of the test pattern printing process as shown in FIG. 13. The line printing process shown in FIG. 13 is the same as that shown in FIG. 5 except that step S702 is added. In FIG. 13, the processing device 70 prints an identification number before printing dot lines 80. S703 through S707 are the same as S202 to S206 in FIG. 5. By thus executing a test pattern printing process, a test pattern as shown in FIG. 14 is formed. Although an identification number 82 is printed before the dot lines 80 are printed as described above, an identification number 82 can be printed after the dot lines 80 are printed.

Figure 15A:
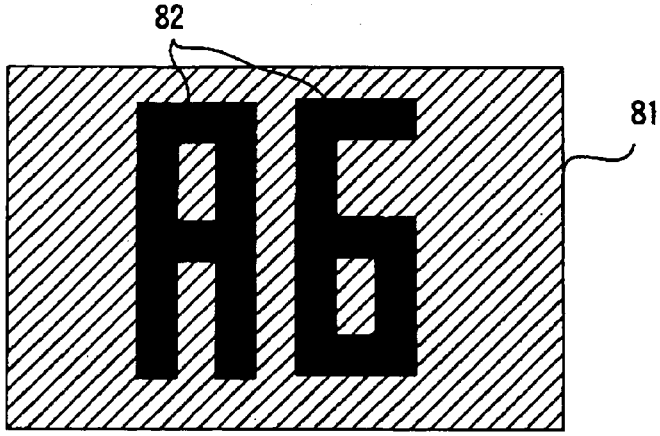
FIGS. 15(A), 15(B) and 15(C) are diagrams showing examples of plane images printed by a test pattern printing process and an information printing process according to modified embodiments.

By printing the identification number 82 including a character and/or a numeral, it is possible to reduce the time needed for identifying a defective nozzle. In the information printing process described above, the identification number 82 is printed close to the plane image 81. The identification number 82 can also be printed inside the plane image, with ink capable of forming a mixed color with the plane image when the plane image is not black, the brightness of which is low. When the test pattern printing process and the information printing process are thus executed, a test pattern as shown in FIG. 15(A) is formed.

Figure 15B:
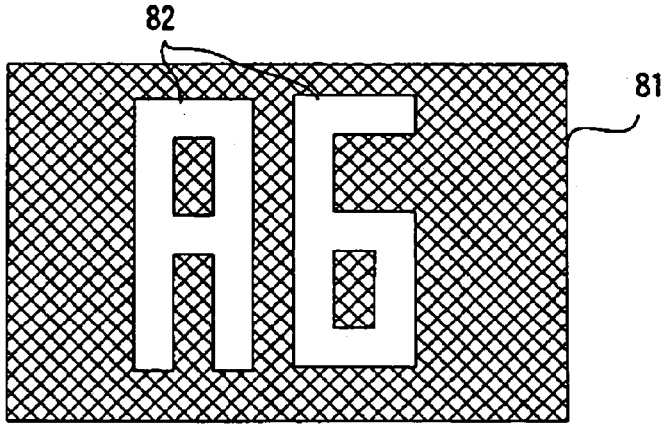

It is also possible to identify a defective nozzle by printing the identification number 82 inside the plane image 81 instead of printing the identification number close to the plane image. When the plane image is not yellow, which is the brightest, it is also preferable to form a non-printed area by driving ink nozzles 10*a*, 10*b*, 10*c* and 10*d* specified by the ink-nozzle number K and the ink-color number J intermittently in S202 of the line printing process shown in FIG. 5, while moving the print head 10. The non-printed area can form an identification number as an outline type font as shown in FIG. 15(B). Therefore, the identification number can be printed by only executing the test-pattern printing process without executing the information printing process.

Figure 15C:
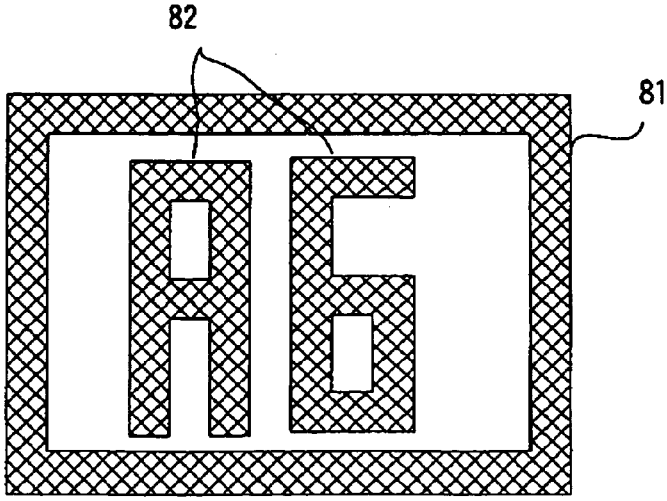

Further, similarly, in S202 of the line printing process shown in FIG. 5, a frame part of the plane image 81 and the identification number can be printed to form a test pattern 81 as shown in FIG. 15(C). Also, instead of printing both the frame part and the identification number in S202 of the line printing process, the frame part and the identification number can be printed individually to form the test pattern 81 shown in FIG. 15(C). For example, the frame part can be printed in S202 of the line printing process, and afterwards, the identification number can be printed in a non-printed area inside the frame by the information printing process.

Figure 16A:
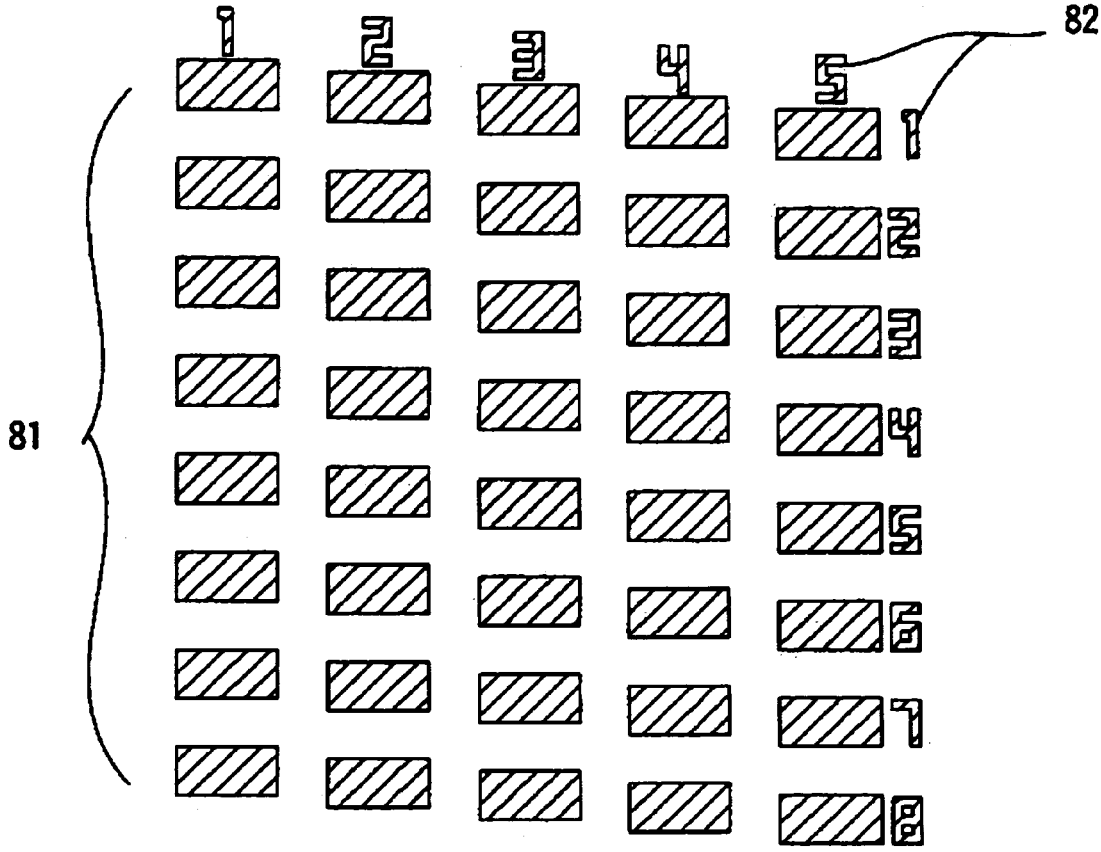
FIGS. 16(A) and 16(B) are diagrams showing examples of plane images arranged in a matrix shape, to which identification numbers are printed.
Figure 16B:
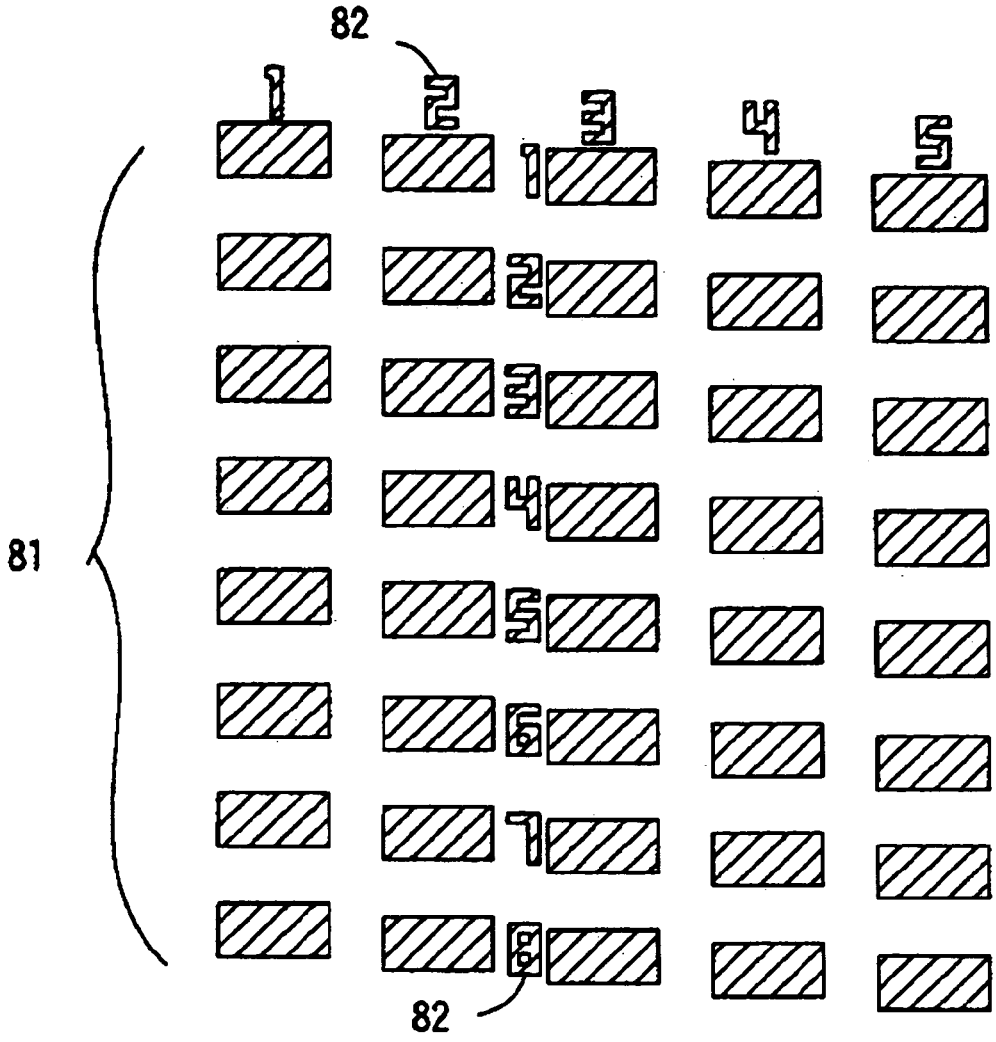

By printing a test pattern as shown in FIG. 15(B) or FIG. 15(C), it is possible to perceive an identification number 82 easily even when the identification number 82 is printed inside the plane image printed with an ink, the brightness of which is low. The identification number can be printed to every plane image, but it is also preferable to print the identification numbers to one row and one column of the plane images 81 arranged in a matrix order as shown in FIG. 16.

In this embodiment, because the plane images 81 are arranged in a matrix order, it is possible to identify each ink nozzle, which has printed each plane image by printing identification numbers to only one row and one column of the plane images 81.

Figure 17A:
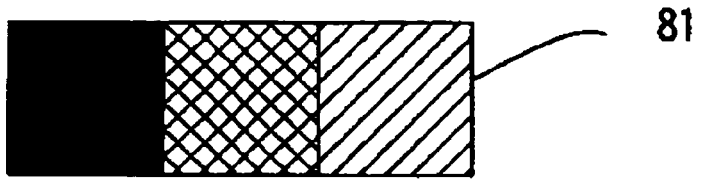
FIGS. 17(A) and 17(B) are diagrams showing examples of plane images printed wherein a size of a dot is varied.
Figure 17B:
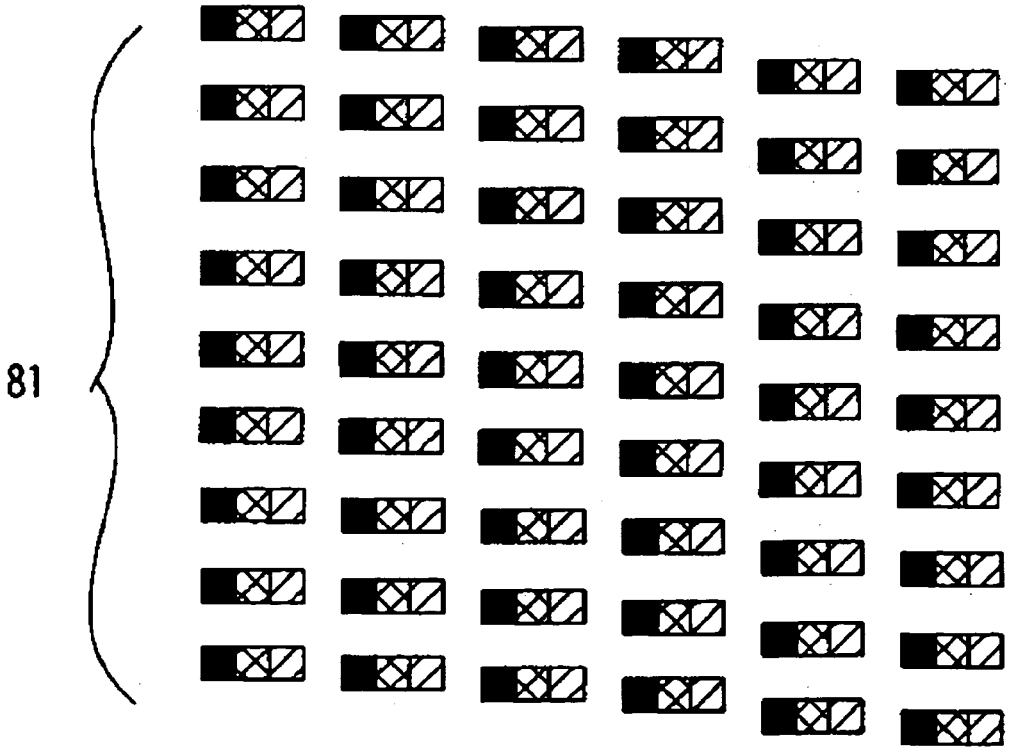

In S202 of the line printing process shown in FIG. 5, the dot line can be printed while a driving condition of ink nozzles 10*a*, 10*b*, 10*c* and 10*d* is fixed. When the dot line is divided into segments, the dot line can be printed while the driving condition is varied every time printing of one of the segments is finished. A test pattern as shown in FIG. 17(A), is printed by the procedure of dividing a dot line to be printed into three segments, printing a first segment with the largest dots, and keeping printing the dot line while reducing a size of the dot every time printing of one of the segments is finished. Test patterns thus printed are arranged in a matrix order as shown in FIG. 17(B).

When an ink nozzle that is almost clogged forms dots on a sheet, the ink nozzle may form dots in some cases, but may not form dots in other cases. Therefore, executing the test pattern printing process only once is not sufficient to check whether an ink nozzle is clogged. By dividing one dot line into segments and varying a size of the dot formed on a recording medium, the difference between normal nozzles and defective nozzles becomes more apparent, and the check on whether ink nozzles are almost clogged becomes easier.

Figure 18:
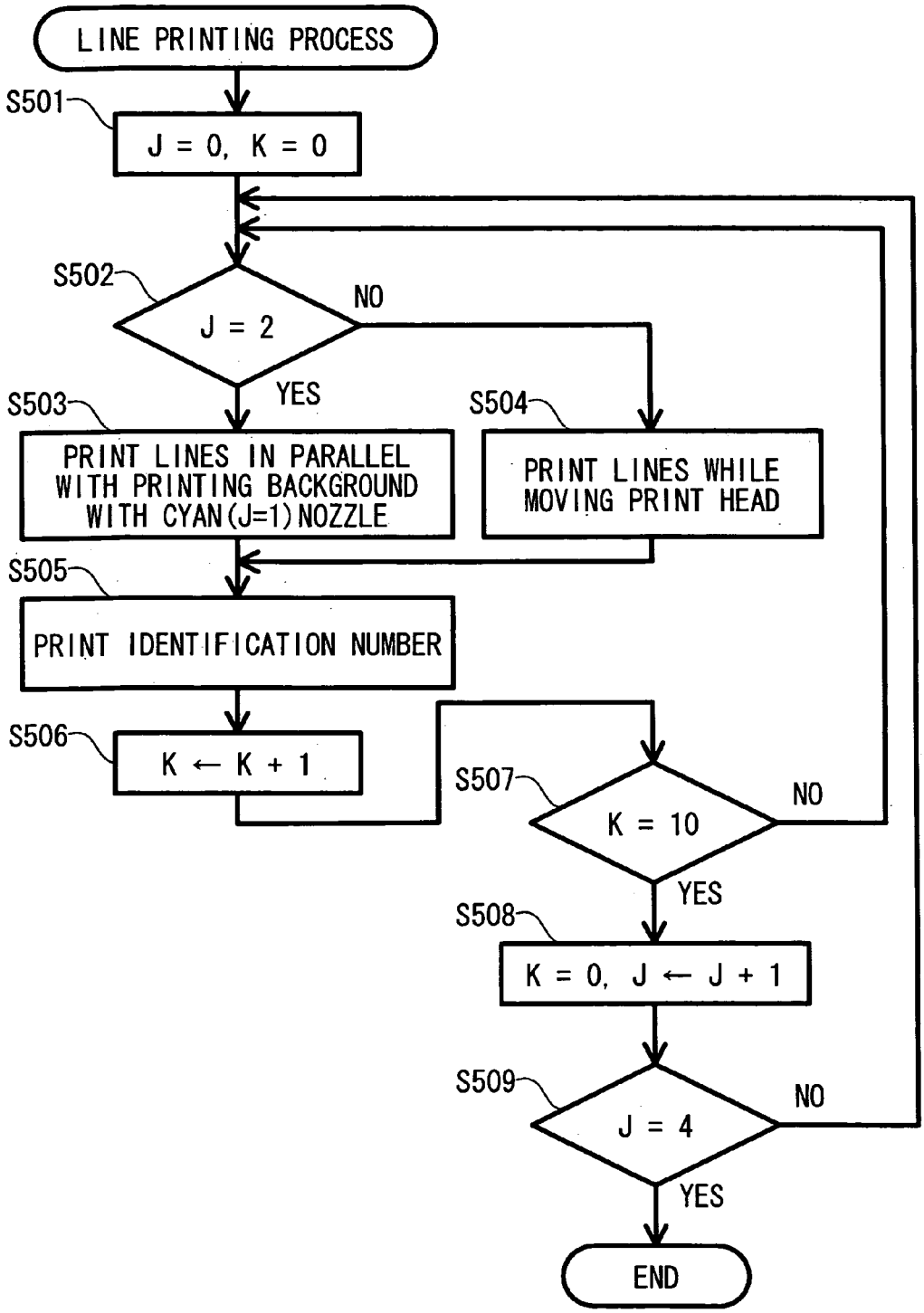
FIG. 18 is a flowchart representing a line printing process according to a modified embodiment.

As shown in FIG. 18, the line printing process (S103) in the flowchart of the test pattern printing process to be executed by the processing device 70, is revised in order that all the processes of printing a dot line, printing a background, and printing information can be executed while the print head moves once in the main scanning direction. The line printing process shown in FIG. 18 is the same as that shown in FIG. 5 except that S202 is replaced with steps of S502–S505.

In FIG. 18, the processing device 70 judges whether the ink color number J is two (J=2 corresponds to yellow in this case). When the ink color number J is two (S502: YES), in S503, the processing device 70 prints dot lines 80 by driving each ink nozzle 10*a*, 10*b*, 10*c*, 10*d* specified by the values of the ink-color number J and the ink-nozzle number K stored in the RAM 73, while moving the print head 10 in the first direction of a sheet in the same way in FIG. 5, and at the same time the processing device 70 prints a background 83 with cyan ink. The time point where the printing of the background 83 is started and the time point where the printing of the background 83 is finished are not necessarily equal to the time point where the printing of the dot lines 80 is started and the time point where the printing of the dot lines 80 is finished, respectively. For example, the printing of the background 83 can be finished after a predetermined interval from when the printing of the dot lines 80 is finished. Then, the flow proceeds to S505 in which the processing unit 70 prints an identification number 82 with the ink nozzles that have printed the dot lines 80 in S503.

When the ink color number J is not two (S502: NO), the flow proceeds to S504 in which the processing device 70 prints dot lines 80 by driving each ink nozzle 10*a*, 10*b*, 10*c*, 10*d* specified by the values of the ink-color number J and the ink-nozzle number K stored in the RAM 73, while moving the print head 10 in the first direction of a sheet in the same way as in FIG. 5. and then the flow proceeds to S505 in which the processing unit 70 prints an identification number 82 with the ink nozzles which have printed the dot lines 80 in S504. S506 through S509 are the same as S203 through S206 in FIG. 5. According to the above-described process, all the information is printed once. Thus, it is possible to reduce the time needed to form a test pattern while improving the visibility of the test pattern.

While the different color plane images are arranged in the first direction that the print head 10 moves, in the above-described embodiments, this arrangement is not necessarily needed. The different color plane images can be arranged in the second direction that a sheet is fed, by changing the order of steps in the test pattern printing process. Even when the different color plane images are arranged in the second direction, it is possible to judge whether each color ink nozzle is clogged by observing a test pattern as easily as it is when the different color plane images are arranged in the first direction.

Also, while a identification number 82 includes characters or numerals, the characters or numerals can be replaced with symbols or marks to identify each ink nozzle 10*a*, 10*b*, 10*c*, 10*d* which is printed in each plane image.

Although the invention has been described in detail with reference to specific embodiments thereof, it would be apparent to those skilled in the art that various changes and modifications may be made therein without departing from the spirit of the invention.

What is claimed is:

1. A method of printing a test pattern on a recording medium by operating an image forming device having a printing element to form dots on the recording medium, and a print head, which mounts the printing element and moves relative to the recording medium, wherein the test pattern is used to inspect the printing element, the method comprising:

a line printing step that prints a dot line in a predetermined region on the recording medium by driving the printing element while moving the print head relative to the recording medium in a first direction of the recording medium; and a moving step wherein the print head and the recording medium move relative to one another in a second direction perpendicular to the first direction of the recording medium such that the printing element can print a dot line adjacent and parallel to a dot line previously printed, wherein the line printing step and the moving step are repeated alternately, whereby the printing element individually prints a plane image which is an assemblage of a plurality of the dot lines as a component part of the test pattern, wherein the print head comprises a plurality of print heads each print head having a plurality of printing elements, each one of the printing elements of one print head being separated from each one of the printing elements of an adjacent print head in a direction approximately parallel to the first direction, wherein a printing element printing the dot line is changed in some steps of the repeated line printing steps, whereby each one of printing elements individually prints the plane image, and a printing element printing the dot line is changed in each step of the repeated line printing steps, whereby each one of printing elements individually prints the plane image.

2. The method of printing a test pattern according to claim 1, wherein the printing elements form dots of a plurality of different colors.

3. The method of printing a test pattern according to claim 2, wherein the printing elements form dots of a plurality of different colors with a plurality of different colors of ink.

4. The method of printing a test pattern according to claim 3, wherein, in addition to a plane image printing step in which the plane image is formed by repeating the line printing step and the moving step alternately, further comprising a background printing step, for printing a background at least on an area where one of the printing elements prints the plane image with the brightest ink among the different colors of ink, by ejecting ink which is not the darkest among the different colors of ink, out of at least one of other printing elements, such that at least a part of the plane image turns a mixed-color.

5. The method of printing a test pattern according to claim 4, wherein bright plane images on which the background is printed, are printed on two different areas in the plane image printing step, and the background is printed on the bright plane image printed on one of the two different areas.

6. The method of printing a test pattern according to claim 1, wherein every printing element of each print head individually prints a dot line in a single motion of the print head.

7. A method of printing a test pattern on a recording medium by operating an image forming device having a printing element to form dots on the recording medium, and a print head, which mounts the printing element and moves relative to the recording medium, wherein the test pattern is used to inspect the printing element, the method comprising:

a line printing step that prints a dot line in a predetermined region on the recording medium by driving the printing element while moving the print head relative to the recording medium in a first direction of the recording medium; and a moving step wherein the print head and the recording medium move relative to one another in a second direction perpendicular to the first direction of the recording medium such that the printing element can print a dot line adjacent and parallel to a dot line previously printed, wherein the line printing step and the moving step are repeated alternately, whereby the printing element individually prints a plane image which is an assemblage of a plurality of the dot lines as a component part of the test pattern, and the print head comprises a plurality of printing elements arranged in a direction approximately parallel to the second direction, wherein the printing elements are divided into blocks, every predetermined number of adjacent printing elements belonging to each one of the blocks, wherein one printing element is selected from each one of the blocks, each one of the selected printing elements being separated at intervals of the predetermined number of printing elements away from each adjacent selected element, wherein each one of the selected elements is driven simultaneously with each one of the other selected elements, and wherein each one of the printing elements to be selected and driven, is changed in every block, during the time when the print head is being moved relative to the recording medium in the first direction in the line printing step, whereby each printing element prints a plane image at predetermined intervals.

8. The method of printing a test pattern according to claim 7, wherein each one of the printing elements to be selected and driven, is changed in order from one end of every block to the other end of the block, whereby plane images printed by printing elements belonging to each one of the blocks are arranged in a certain direction, thereby forming a column, and plane images printed simultaneously are arranged in a direction approximately parallel to the second direction, thereby forming a row, the columns and the rows forming a matrix.

9. The method of printing a test pattern according to claim 8, further comprising an information printing step for printing information in the vicinity of at least one column and one row arbitrarily selected from the matrix of the two-dimensional patterns to identify a printing element which printed a plane image specified by the column and the row.

10. The method of printing a test pattern according to claim 7, further comprising an information printing step for printing information to identify each printing element which printed each plane image on the recording medium.

11. The method of printing a test pattern according to claim 10, wherein the information is an identification number comprising numerals or characters.

12. The method of printing a test pattern according to claim 11, wherein the identification number is printed in the vicinity of the plane image.

13. The method of printing a test pattern according to claim 11, wherein the identification number is printed inside the plane image.

14. The method of printing a test pattern according to claim 13, wherein the printing element is driven intermittently in the repeated line printing steps such that a non-printed area is formed inside the plane image.

15. The method of printing a test pattern according to claim 7, wherein the dot line is printed under an approximate same condition in every line printing step such that the plane image becomes a parallelogram.

16. The method of printing according to claim 7, wherein successive line printing steps are done in opposite directions and the driving of print elements is determined based on the direction of line printing.

17. The method of printing a test pattern according to claim 7, wherein every printing element of each print head individually prints a dot line in a single motion of the print head.

18. A method of printing a test pattern on a recording medium by operating an image forming device having a printing element to form dots on the recording medium, and a print head, which mounts the printing element and moves relative to the recording medium, wherein the test pattern is used to inspect the printing element, the method comprising:

a line printing step that prints a dot line in a predetermined region on the recording medium by driving the printing element while moving the print head relative to the recording medium in a first direction of the recording medium; and a moving step wherein the print head and the recording medium move relative to one another in a second direction perpendicular to the first direction of the recording medium such that the printing element can print a dot line adjacent and parallel to a dot line previously printed, wherein the line printing step and the moving step are repeated alternately, whereby the printing element individually prints a plane image which is an assemblage of a plurality of the dot lines as a component part of the test pattern, and the printing element is structured such that a size of the dot is variable, the dot line is divided into a plurality of segments, and the size of the dot is varied every time printing of one of the segments is finished in the line printing step.

19. An image forming device which has a printing element to form dots on a printing medium and a print head which mounts the printing element and moves relative to the recording medium, comprising:

a line printing element that prints a dot line in a predetermined region on the recording medium by driving the printing element while moving the print head relative to the recording medium in a first direction of the recording medium;

a movement mechanism that moves the print head and the recording medium relative to one another in a second direction perpendicular to the first direction of the recording medium such that the printing element can print a dot line adjacent and parallel to a dot line previously printed; and a controller that drives the line printing element and the movement mechanism alternately to form a plane image, wherein the plane image is a component part of a test pattern which is used to inspect each printing element, the print head comprises a plurality of print heads each having a plurality of printing elements, each one of the printing elements of one print head being separated away from each one of the printing elements of an adjacent print head in a direction approximately parallel to the first direction, wherein the controller changes a printing element which the line printing element drives, every time the line printing element prints the dot line in the first direction.

20. The image forming device according to claim 19, wherein the printing elements form dots of a plurality of different colors.

21. The image forming device according to claim 20, wherein the printing elements form dots of a plurality of different colors with a plurality of different colors of ink.

22. The image forming device according to claim 21, further comprising a background printing element that prints a background at least on an area where one of the printing elements prints the plane image with the brightest ink among the different kinds of color ink, by ejecting ink which is not the darkest among the different colors of ink, out of at least one of other printing elements such that at least a part of the plane image turns a mixed-color.

23. The image forming device according to claim 22, wherein the controller controls the line printing element such that the line printing element prints bright plane images on which the background is printed, on two different areas, and the background printing element prints the background on the bright plane image printed on one of the two different areas.

24. The image forming device according to claim 19, wherein every printing element of each print head individually prints a dot line in a single motion of the print head.

25. An image forming device which has a printing element to form dots on a printing medium and a print head which mounts the printing element and moves relative to the recording medium, comprising:

a line printing element that prints a dot line in a predetermined region on the recording medium by driving the printing element while moving the print head relative to the recording medium in a first direction of the recording medium;

a movement mechanism that moves the print head and the recording medium relative to one another in a second direction perpendicular to the first direction of the recording medium such that the printing element can print a dot line adjacent and parallel to a dot line previously printed; and a controller that drives the line printing element and the movement mechanism alternately to form a plane image, wherein the plane image is a component part of a test pattern which is used to inspect each printing element, and the print head comprises a plurality of printing elements arranged in a direction approximately parallel to the second direction, wherein the controller divides the printing elements into blocks, every predetermined number of adjacent printing elements belonging to each one of the blocks, the controller selects one printing element from each one of the blocks, each one of the selected printing elements being separated at intervals of the predetermined number of printing elements away from each adjacent selected elements, the controller controls the line printing element such that the line printing element drives the selected printing elements simultaneously, and the controller changes the printing elements, to be selected and driven, in every block during the time when the line printing element moves the print head relative to the recording medium in the first direction, whereby plane images are printed at predetermined intervals.

26. The image forming device according to claim 25, wherein the controller selects each one of the printing elements from one end of every block to the other end of the block, whereby plane images printed by printing elements belonging to each one of the blocks are arranged in a certain direction, thereby forming a column, and plane images printed simultaneously are arranged in a direction approximately parallel to the second direction, thereby forming a row, the columns and the rows forming a matrix.

27. The image forming device according to claim 26, further comprising an information printing unit that prints information in the vicinity of at least one column and one row arbitrarily selected from the matrix of the plane images to identify a printing element which printed a plane image specified by the column and the row.

28. The image forming device according to claim 25, further comprising an information printing unit that prints information to identify each printing element which printed each plane image on the recording medium.

29. The image forming device according to claim 28, wherein the information is an identification number comprising numerals or characters.

30. The image forming device according to claim 29, wherein the identification number is printed in the vicinity of the plane image.

31. The image forming device according to claim 29, wherein the identification number is printed inside the plane image.

32. The image forming device according to claim 31, wherein the controller controls the line printing element such that the line printing element drives the printing element intermittently to form a non-printed area inside the plane image.

33. The image forming device according to claim 25, wherein the controller controls the line printing element under an approximate same condition such that the plane image becomes a parallelogram.

34. The image forming device according to claim 25, wherein the controller controls the line printing element to print in opposite directions for successive dot lines and the printing element is determined based on the direction of printing.

35. The image forming device according to claim 25, wherein every printing element of each print head individually prints a dot line in a single motion of the print head.

36. An image forming device which has a printing element to form dots on a printing medium and a print head which mounts the printing element and moves relative to the recording medium, comprising:

a line printing element that prints a dot line in a predetermined region on the recording medium by driving the printing element while moving the print head relative to the recording medium in a first direction of the recording medium;

a movement mechanism that moves the print head and the recording medium relative to one another in a second direction perpendicular to the first direction of the recording medium such that the printing element can print a dot line adjacent and parallel to a dot line previously printed; and a controller that drives the line printing element and the movement mechanism alternately to form a plane image, wherein the plane image is a component part of a test pattern which is used to inspect the printing element, and the printing element is structured such that a size of the dot is variable, the controller divides the dot line into a plurality of segments and controls the line printing element such that the line printing element varies the size of the dot every time the line printing element finishes printing one of the segments.

* * * * *